US009702151B2

(12) United States Patent
Cohen et al.

(10) Patent No.: US 9,702,151 B2
(45) Date of Patent: Jul. 11, 2017

(54) MOBILE SHADE SYSTEMS

(71) Applicant: CUBERT LLC, Hayward, CA (US)

(72) Inventors: Matt Cohen, San Francisco, CA (US); Benjamin Himlan, Oakland, CA (US); José Miguel Urrechaga, Los Vilos (CL); Jaime Lorca, Vitacura (CL)

(73) Assignee: CUBERT LLC, Hayward, CA (US)

( * ) Notice: Subject to any disclaimer, the term of this patent is extended or adjusted under 35 U.S.C. 154(b) by 0 days.

(21) Appl. No.: 14/668,912

(22) Filed: Mar. 25, 2015

(65) Prior Publication Data

US 2016/0281384 A1 Sep. 29, 2016

(51) Int. Cl.

| | |
|---|---|
| ***E04H 15/58*** | (2006.01) |
| ***E04F 10/06*** | (2006.01) |
| ***E04F 10/10*** | (2006.01) |
| ***E04B 1/344*** | (2006.01) |
| *E04H 1/12* | (2006.01) |
| *E04H 3/02* | (2006.01) |
| *E04H 3/08* | (2006.01) |

(52) U.S. Cl.

CPC ..... *E04F 10/06* (2013.01); *E04B 1/3444* (2013.01); *E04F 10/10* (2013.01); *E04F 10/0662* (2013.01); *E04F 10/0685* (2013.01); *E04H 1/1216* (2013.01); *E04H 3/02* (2013.01); *E04H 3/08* (2013.01); *E04H 15/58* (2013.01)

(58) Field of Classification Search

CPC ..... E04H 15/18; E04H 15/10; E04H 15/46; E04H 15/48; E04H 15/58; E04H 15/30; E04H 15/32; E04H 15/008; E04H 1/005; E04B 31/344; E04B 7/166; E04B 1/343

USPC ..... 135/91, 95–97, 143–144, 148, 151, 117, 135/120.4, 905; 52/66–68, 79.5, 169.12

See application file for complete search history.

(56) References Cited

U.S. PATENT DOCUMENTS

| | | | |
|---|---|---|---|
| 2,787,028 | A | 4/1957 | Webb |
| 3,526,067 | A | 9/1970 | Furter et al. |
| 3,577,672 | A | 5/1971 | Nutting |
| 3,643,390 | A | 2/1972 | Shelley |
| 3,911,634 | A | 10/1975 | Horowitz et al. |
| 4,295,431 | A | 10/1981 | Stavlo |

(Continued)

OTHER PUBLICATIONS

U.S. Appl. No. 29/503,590, by Cohen et al., entitled "Shade Container with Shade Mode and Storage Mode," filed on Sep. 26, 2014; Office Action dated Jan. 15, 2015.

(Continued)

*Primary Examiner* — Winnie Yip
(74) *Attorney, Agent, or Firm* — Dergosits & Noah LLP

(57) ABSTRACT

The invention provides equipment for protection from the sun and other weather elements. The equipment comprises container structures that collapse into a closed, compact, highly portable configuration, and unfold into an open position to provide a variety of convenient structures that provide protection from weather elements, and in particular, provide a shaded environment. The invention provides individual shade containers as well as modular multi-container extended shade systems. The compositions of the invention have a variety of uses, including uses as portable shelters for outdoor market vendors and outdoor entertainment. The individual shade containers and the multi-container shade systems are highly customizable to any particular intended use.

16 Claims, 18 Drawing Sheets

(56) References Cited

U.S. PATENT DOCUMENTS

| | | | | |
|---|---|---|---|---|
| 4,843,788 | A | 7/1989 | Gavin et al. | |
| 5,375,899 | A * | 12/1994 | Wright | B60P 3/025 296/21 |
| 5,463,833 | A * | 11/1995 | Banez | E04H 1/1205 52/69 |
| 5,761,854 | A * | 6/1998 | Johnson | B60P 3/34 135/116 |
| 6,223,479 | B1 * | 5/2001 | Stockli | E04B 1/3442 52/126.1 |
| 6,345,471 | B1 * | 2/2002 | Gyllenhammar | E04B 1/3444 296/169 |
| 7,178,536 | B2 * | 2/2007 | Holtkamp | E04H 15/08 135/88.12 |
| 7,360,813 | B2 * | 4/2008 | Ting | A61G 3/001 296/24.38 |
| D575,878 | S | 8/2008 | Bartlett | |
| 7,658,037 | B2 * | 2/2010 | Bucher | E04B 1/3431 52/67 |
| 8,347,560 | B2 * | 1/2013 | Gyory | E04B 1/3444 52/64 |
| 8,863,445 | B2 | 10/2014 | Zhong | |
| 8,939,164 | B2 * | 1/2015 | Combs | E04H 15/54 135/115 |
| D740,442 | S | 10/2015 | Cohen et al. | |
| D745,978 | S | 12/2015 | Cohen et al. | |
| 2005/0224494 | A1 * | 10/2005 | Heinrichs | B65D 7/28 220/4.28 |
| 2015/0034634 | A1 * | 2/2015 | Mullaney | E04B 1/3431 220/1.5 |

OTHER PUBLICATIONS

U.S. Appl. No. 29/503,590, by Cohen et al., entitled "Shade Container with Shade Mode and Storage Mode," filed on Sep. 26, 2014; Office Action dated May 27, 2015.

U.S. Appl. No. 29/503,591, by Cohen et al., entitled "Shade Container with Shade Mode and Storage Mode," filed on Sep. 26, 2014; Office Action dated Jan. 15, 2015.

U.S. Appl. No. 29/503,591, by Cohen et al., entitled "Shade Container with Shade Mode and Storage Mode," filed on Sep. 26, 2014; Office Action dated May 19, 2015.

* cited by examiner

MOBILE SHADE SYSTEMS

CROSS-REFERENCE TO RELATED APPLICATIONS

This application claims priority benefit of U.S. Design Patent Applications having Serial Nos. 29/503,590, filed on Sep. 26, 2014, and Ser. No. 29/503,591, filed on Sep. 26, 2014, both of which are herein incorporated by reference in their entirety.

FIELD OF THE INVENTION

The invention relates generally to equipment for protection from the sun and other weather elements. The equipment comprises structures that collapse into highly portable containers, and unfold to provide convenient, extended structures that provide protection from weather elements, and in particular, provide a shaded environment. The compositions and systems of the invention find a variety of uses, including portable shelters for outdoor markets, outdoor entertainment, outdoor social functions and outdoor dining.

BACKGROUND OF THE INVENTION

Excessive exposure to sunlight is unhealthy to human physiology. In many circumstances, exposure to sunlight, even when filtered through clouds, can be a health risk and can make being outdoors unpleasant. In addition, some activities are made difficult or sub-optimal in bright sunlight, such as eating/dining, reading, watching outdoor entertainment and shopping.

What is needed in the art are cost effective, pre-constructed mobile weather shelters that can be transported and erected at any desired outdoor site, and in particular, can provide mobile shaded environments. Ideally, such mobile shelters are (i) easily transported, such as by truck or towed as a trailer, (ii) are self-contained, and do not require any additional materials at the site where they will be used, and (iii) are pre-constructed and can be erected without the use of special tools.

The present invention, in its many embodiments, provides solutions to these problems, have a number of advantages over the state of the art and provide many benefits previously unrealized in other types of products. In addition, still further benefits flow from the invention described herein, as will be apparent upon reading the present disclosure.

SUMMARY OF THE INVENTION

The present disclosure provides equipment that can be deployed to provide useful spaces that offer protection from weather elements, most notably, protection from the sun. The equipment comprises containers that are characterized by an open position and a closed position, where generally the containers are formed around a rigid frame which provides an immobile substructure on which are attached the various panels and other components to form the container. The faces of the container installed around the rigid frame are a fixed top panel, a fixed bottom panel, and four rotatable side panels. The side panels are in a vertical orientation when the container is in the closed position (the "storage mode"), and are in a horizontal position when the container is in an open deployed position (the "shade mode").

The containers can comprise one or more upwardly pivoting side panels. In some embodiments, all four side panels are upwardly pivoting side panels that are rotatably fastened to the container or upper horizontal portion of the rigid frame along their top edge by a rotating fastener means, such as a hinge. When the container is in the closed position, each of the side panels is moveably disposed about one vertical face of the rigid frame. When the container is in the open position, the four upwardly pivoting side panels have a horizontal orientation that is substantially coplanar with the plane of the fixed top panel.

In some embodiments, at least one, or more typically two, of the upwardly pivoting side panels comprises within the panel at least one, and typically two, supplemental extendable shade elements. These shade elements are contained within and fully retracted within vertical panels when the container is in the closed position. When the container is in the open position, the two extendable shade elements are each extended outward from opposing side edges of the side panels, and the extendable shade elements are substantially horizontal and substantially coplanar with the plane of the fixed top panel and the plane of the raised upwardly rotating side panel.

In some alternative embodiments, the extendable shade elements are externally mounted on one face of the upwardly pivoting side panels. These extendable shade elements are not recessed within the side panels. Instead, they are installed on an exterior face of the side panel in a manner that permits them to slide inward and outward relative to one side of the side panel.

In some embodiments, the containers comprise fewer than four upwardly rotating side panels, and alternatively, comprise one or more side panel that is a downwardly rotating side panel that is rotatably fastened along the lower edge of the panel to a lower horizontal portion of the rigid frame or the fixed bottom panel of the container, e.g., by a hinge. This downwardly rotating side panel is vertical in the closed position, but in the open position, is substantially horizontal and substantially coplanar with the plane of the fixed bottom panel. Shade containers comprising at least one downwardly rotating side panel can also comprise one or more, typically two, upwardly pivoting side panels that contain extendable shade elements.

Ramps find a variety of uses with the invention. In one embodiment, at least one ramp is functionally coupled to the container. In one aspect, the ramp is detachable from the container and where the proximal edge of the ramp abuts the fixed bottom panel or a lower horizontal portion of the rigid frame of the container. In another aspect, the ramp is integrated into the container structure, where the ramp is rotatably fastened to a lower horizontal portion of the rigid frame or the bottom panel. In this configuration, the ramp is rotatable from a closed position that is either vertically oriented or horizontally oriented in a parallel plane that overlaps the fixed bottom panel, to an open position that is substantially horizontal and non-overlapping with the fixed bottom panel, i.e., the ramp folds outward from the container into a horizontal position or nearly horizontal position outside of the footprint of the container.

The containers of the invention can be modified in a variety of ways. In some embodiments, at least one hydraulic arm, and in some cases two hydraulic arms, can be integrated into the container to help support and control the weight of the rotatable side panels. They are be attached to a vertical panel, which can be an upwardly rotating panel or a downwardly rotating panel, and at the opposite end coupled to a segment of the immobile rigid frame. This is done to control the rate at which a side panel will rise or be lowered from the closed to the open position. Integrated pulley systems can also be employed to assist in the raising and lowering of the side panels.

Any container of the invention can be engineered to contain an electrical system to distribute AC or DC power to the container, for example, to electrical outlets or to power hardwired electrical devices within the container, such as lighting systems, audio equipment/speakers, smoke detectors, cooking equipment or first-aid equipment. An electrical system can comprise wiring or electrical conduits, distribution junctions, outlets, and suitable input connectors to accept an external power source such as from an external AC generator or a battery source. With regard to lighting systems, any suitable type of lighting system can find use with the containers of the invention, which systems may include light switches or controls, wiring, conduits, and the actual light fixtures. A lighting system can be any suitable system that uses AC or DC.

In other embodiments, the open position of the container optionally uses at least one vertical support element to help support the weight of the horizontally oriented side panel. The vertically oriented support element can be a pole or column that is attached at or near the distal (bottom) edge of the horizontal upwardly pivoting side panel and contacts the ground (or contacts any type of stable base that is contacting the ground) when the container is in the open position. The support element is removed or repositioned when the container is in the closed position.

The invention also provides modular shade systems that comprise a plurality of shade containers, termed shade container modules when they are incorporated into a modular shade system. In the modular shade systems, a plurality of shade container modules are functionally coupled together by suitable coupling means, resulting in protected (e.g., shaded) spaces that are larger than a single shade container, and further, can have functionality that is not possible with a single shade container.

The shade container modules used to construct the modular shade systems of the invention are of the same general design and construction as the stand-alone shade containers described herein. The shade container modules can be identical to the stand-alone shade containers, or can be modified for use in the modular shade system.

In some aspects, the coupling means used to functionally join two or more individual shade container modules is a direct coupling, where the two or more container modules are at least abutting each other, and in some embodiments, are fastened to each other, without the use of any supplemental shading materials. For example, in one embodiment, a first container module comprising at least one upwardly rotatable side panel in a raised open horizontal position is positioned adjacent to a second container module comprising at least one downwardly rotatable side panel in an open position, where the distal edge of the raised upwardly rotatable side panel on the first container module is abuts the second container, and the distal edge of the downwardly rotatable side panel on the second container abuts the first container. In addition to abutting the adjacent container, the rotatable side panels can be fastened to the opposing container module. For example, the distal edge of the upwardly rotatable side panel on the first container can be fastened to an upper horizontal portion of the rigid frame on the second container, and similarly, the distal edge of the downwardly rotatable side panel on the second container can be fastened to a lower horizontal portion of the rigid frame on the first container.

In other aspects, the coupling means used to functionally link two or more individual shade container modules can be an indirect coupling, where the coupling means is by at least one supplemental shade element that is used to connect one container module to a second container module. Generally, the supplemental shade element is connected at one end to the first container module (typically on the top panel of the container or at an elevated position on the open container), and connected on the opposite end to the second container module, similarly on the top panel or elevated position. The supplemental shade element is suspended in a substantially horizontal configuration forming a contiguous shaded area between the first container module and second container module, thereby functionally coupling the first and second container modules. Thus, the extended modular shade system provides a shaded area that includes not only the shaded areas under the deployed container modules, but also includes the contiguous shaded area between the first and second containers provided by the supplemental shade element.

In some embodiments, the supplemental shade element is a rolling shade element, where the shade material is reversibly rolled and fastened to the first container module when the modular shade system is in the closed position. To form the open position, the free end of the rolling shade is unrolled and extended from the first container module and attached to the second container module by any suitable attachment means, such as any combination of loops, rings or hooks that are installed on the rolling shade and on the second container. The rolling shade can be made from any suitable material, natural or synthetic, for example, a fabric material such as canvas.

BRIEF DESCRIPTION OF THE DRAWINGS

FIGS. 14A through 14C provide perspective view illustrations of assembly of the modular system. FIG. 14A shows the two shade containers in the fully closed positions. FIG. 14B shows a first container in the fully closed position and a second container where one downwardly pivoting side panel is in the deployed position and contacting the first container. FIG. 14C shows the deployment of one upwardly pivoting side panel from the first container.

FIGS. 14D through 14F provide side elevation views of the same deployment process as shown in FIGS. 14A-14C. FIG. 14D shows the two shade containers in the fully closed positions. FIG. 14E shows a first container in the fully closed position and a second container where one downwardly pivoting side panel is being deployed into a horizontal position. FIG. 14F shows the first container with the full deployment of one upwardly pivoting side panel and the second container with the full deployment of the downwardly pivoting side panel into a horizontal position.

DETAILED DESCRIPTION OF THE INVENTION

The invention provides highly mobile containers for shade protection and other usable protected space that find a variety of uses. The highly specialized containers offer protection from weather elements; most significantly, they offer protection from sun exposure. The containers and multi-container systems of the invention have a number of desirable features, including: (i) the containers are entirely pre-constructed, so there is no construction, additional materials or special tools required at the site of use; (ii) the containers have two configurations, which are an unfolded, open configuration that provides the weather shelter, and a highly compacted closed configuration that is convenient for transportation between sites or for storage of the container; (iii) the conversion of the closed form to the open form does not require any special tools or materials; and (iv) the closed form also has capacity as a storage container, so additional materials or equipment that might be used in conjunction with the mobile shade container can be stored in the same container for convenient access at the site of use. Examples of materials that might be stored in a shade container include ramps, stacking chairs, tables, traffic barricades and traffic cones, audio speakers and other sound equipment, a collapsible performance stage, stage lighting, portable electric generator, trash cans, workspace lighting, first-aid equipment and other medical supplies, and equipment for preparing and serving food and drink.

The shade containers of the invention have a wide variety of uses, including but not limited to farmers markets, outdoor vendor stalls for selling goods or services, any type of food or drink concessions, any types of trade shows or product fairs, temporary outdoor medical first aid stations or other types of mobile medical facilities, shelters for portable toilets, outdoor eating/dining, outdoor entertainment such as by providing a sheltered performance stage for musical or theatrical productions, event registration or volunteer coordination centers for large outdoor events, and an on-site office or meeting point for construction projects.

Shade Containers and Materials

The shade containers contain a rigid, structural frame, to which a floor panel, ceiling panel, four side panels and optional other features are attached. In construction of the containers, the rigid frame is first assembled, and then the remaining elements are attached to the frame. The manner in which the various elements of the container are attached to the rigid frame is not limited. In some embodiments, the floor panel and ceiling panel are substantially fixed to the rigid frame, where those panels are permanently fixed into position on the rigid frame, or are integrated into the rigid frame of the container. These top and bottom panels typically do not have any degree of movement around the rigid frame.

Figure 15A:
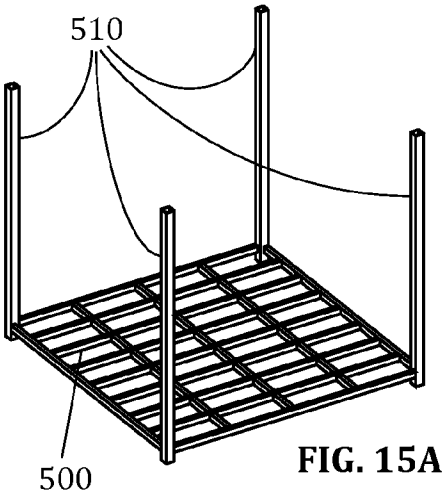
FIGS. 15A through 15E provide illustrations demonstrating the general step-wise assembly of a rigid frame used to construct a shade container.
Figure 15B:
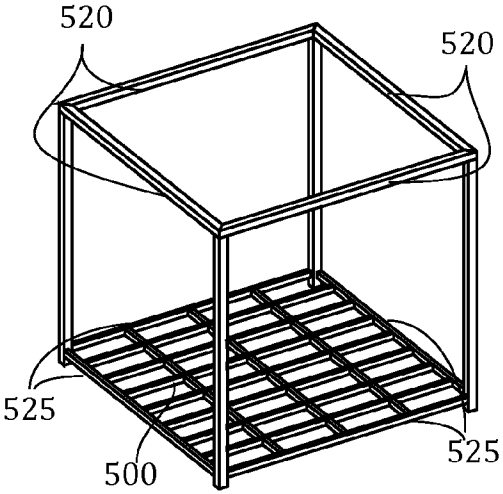
Figure 15C:
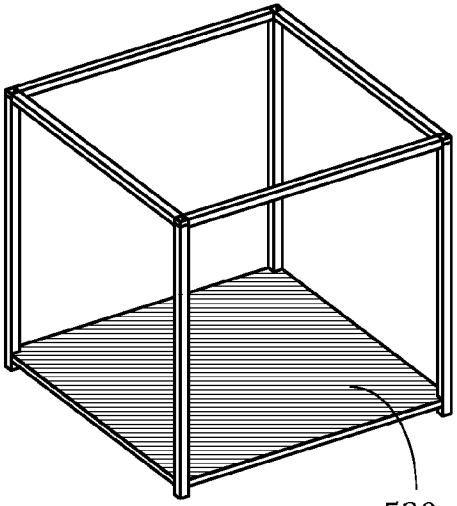
Figure 15D:
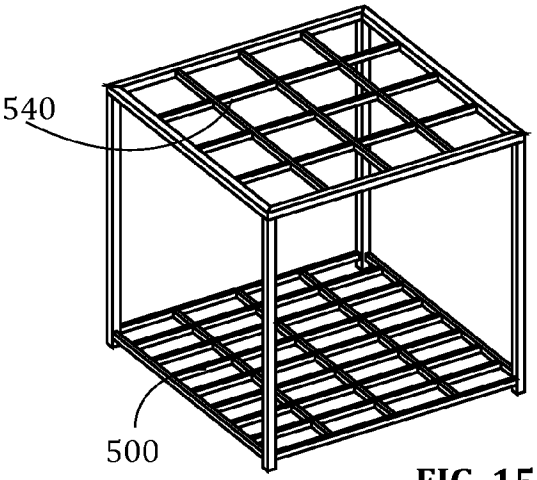
Figure 15E:
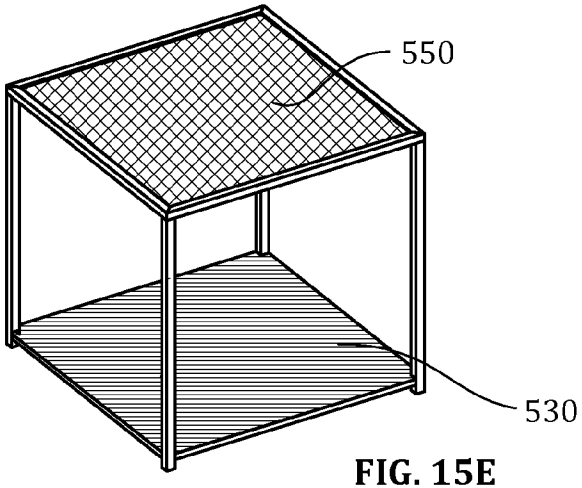

FIGS. 15A through 15E provide illustrations demonstrating the general step-wise assembly of a rigid frame used to construct a shade container. FIG. 15A shows the horizontal lattice-like framework 500 of the bottom floor panel, to which are attached four vertical pillars 510. In FIG. 15B, the four vertical pillars 510 have been interconnected by four upper horizontal supports 520 and four lower horizontal supports 525. In FIG. 15C, a surface sheathing 530 has been added on top of and attached to the floor lattice framework to form the complete floor panel. FIG. 15D shows the addition of elevated horizontal lattice-like framework 540 that provides the structural support for a ceiling panel. FIG. 15E shows the addition of surface sheathing 550 to cover the ceiling framework 540. FIG. 15E also shows the addition of the surface sheathing 530 that covers the bottom panel framework 500.

In contrast to the floor and ceiling panels, one or more of the side panels of a shade container are typically non-fixedly attached, e.g., are rotatably fastened, to the rigid frame or to the permanent floor panel or ceiling panel. The attachment(s) between the side panel and the container structural framework are made in a manner that allows movement of the side panel around the frame, for example, where the side panels can rotate or pivot around the rigid frame. A side panel can be attached to the rigid frame either along to top edge of the side panel to an upper horizontal support element of the rigid frame, thereby allowing the panel to rotate upwards into a horizontal position (see for example FIG. 1B, side panels 140, 141, 142 and 143, and FIGS. 3A and 3B). Alternatively, a side panel can be attached to the rigid frame along the bottom edge of the panel to a lower horizontal support element of the rigid frame (or the floor of the container), thereby allowing the panel to rotate downwards into a horizontal position (see for example FIG. 2B side panel 250, and FIG. 6B panel 250).

The non-fixed attachment between the side panel and the rigid frame or permanent floor panel or ceiling panel is most typically by a rotatable fastening, such as by any suitable hinge mechanism. A variety of hinge designs suitable for use in the presently described shade containers are known in the art and are not limiting in design or materials.

The rigid frame (see FIGS. 15A through 15E, including the bottom and top support framework 500 and 540, the vertical pillars 510, and horizontal structural support elements 520) can be made from any suitable materials. One of ordinary skill is well aware of a wide variety of materials that can be used to construct this type of support structure, such as but not limited to various alloys of steel and/or aluminum and composite materials. Aluminum and aluminum composites offer the advantage of lighter weight compared to steel construction. Combinations of materials, such as combinations of metal and non-metal materials can also be used to form the rigid framework, and/or subparts of the rigid framework. Non-metal materials such as wood, PVC and any other suitable types of plastics, or fiberglass are also contemplated as construction materials.

Similarly, the surface sheathing for the top panel, bottom panel, any side panels, any extendable shade elements, and any ramps used in conjunction with the shade containers can be constructed from any of a variety of suitable materials as know to one of skill in the art. For example, such materials include diamond plates of various steel alloys, or plates or sheets of aluminum or aluminum alloys. In some embodiments, panels formed from ALUCOBOND® aluminum composite material are used. Non-metal materials are also contemplated in the construction of any of the panels or extendable shade elements, or ramps, including but not limited to wood, PVC and any other suitable types of plastics, or fiberglass.

In some embodiments, the shade containers are of hybrid construction that use two or more materials in the construction of the containers. It is not intended that the invention be limited to any particular construction material or combination of materials.

Closed Storage Mode

The shade containers of the invention can be set in either one of two modes. The first mode is termed the closed configuration or "storage mode." In the closed storage mode, the side panels of the container are in a vertical orientation, and all four edges of any one side panel are disposed or aligned with adjacent vertical and horizontal portions of the rigid structural frame. For example, see FIGS. 1A, 2A, 3A and 6A. In order to stabilize the closed position, the rotatable side panel(s) can be locked or secured in place using any suitable means, for example, any type of hooks, latches or straps, which can be on either the interior or exterior of the container, or both. When in the closed configuration, these non-permanent attachments temporarily secure the vertical side panels to either the rigid frame, the bottom or top panels, or to any adjacent side panel, or any combination of these attachments.

In some embodiments, each of the panels that form the container (i.e., the top panel, bottom panel, and four side panels) are approximately square and of the same dimension, and when the container is in the closed position, the container forms a cube with approximately equal length, width and height. In other design options, the closed container need not be a cube, and can be any geometry. For example, the container can be taller than it is wide. Alternatively, the container can be wider than it is tall. Alternatively still, the four side panels do not all need to have the same dimensions, where the side panels can have unequal lengths, forming a container with a rectangular or elongated geometry. It is not intended that the container be limited to any particular dimensions. In one embodiment, the closed configuration of the container is approximately a cube that measures approximately 8 feet in each dimension.

Mobility

In generally preferred embodiments, the shade containers are intended to be mobile, in particular, when they are in the closed storage mode. To facilitate this, the rigid structural framework and floor panel are designed to permit the use of a forklift to move the container, where the floor of the container can be either elevated on suitable legs (see for example, FIGS. 15A-15E, 16 and 17E) or sits on a suitable permanent platform (see for example, FIGS. 3A, 3B, 5A and 5B, showing the forklift platform 125 and the fixed bottom floor panel 120; and see FIGS. 6A and 6B showing the forklift platform 225 and the fixed bottom floor panel 220). When the container sits on a forklift platform, that platform can have a footprint on the ground of any size, for example, having a footprint identical in size to the footprint of the container floor panel, or it can have a footprint that is smaller than the container floor panel. In these configurations, the level of the floor panel is raised above the level of the ground, thereby permitting the forks of a forklift to move under the container and easily raise the container. The containers can be transported on or in any suitable truck or trailer system.

Open Shade Mode

The second container mode is the deployed, open configuration, also termed the "shade mode." See for example FIGS. 1B, 5B and 17A-17E. In the shade mode, the various rotatably fastened side panel(s) are rotated away from their closed vertically-disposed position and are either elevated or lowered into substantially horizontal positions. The side panels rise to horizontal positions approximately coplanar with the fixed top panel, thereby creating shaded, protected spaces below.

In some embodiments, one or more side panel rises upwards, for example, by using a hinge mechanism that connects the upper edge (i.e., top edge) of the side panel to a top portion of the container, which can be either a top portion of the rigid frame or the fixed top panel. Thus, the lower edge of this panel can be lifted to bring the side panel to a substantially horizontal configuration that is substantially coplanar with the top ceiling panel. In this manner, one or more side panel can be raised to provide a shaded area below.

Where a vertical panel is rotatably fastened to an upper horizontal portion of the rigid frame, that panel is characterized by an upper edge (or top edge) that is fastened to the rigid frame, and a bottom edge that is juxtaposed (but not attached) to a bottom horizontal portion of the rigid frame or the bottom panel when the container is in the closed position. When the container is deployed into an open shade-mode configuration, that upwardly rotatable panel is raised to a horizontal position approximately coplanar with the fixed top panel. When in the shade mode, that horizontally-oriented raised side panel is characterized by having a proximal edge that remains fastened to the rigid frame (i.e., the edge that was termed the "upper" edge when the container was in the closed position) and a distal edge that is furthest from the container frame (i.e., the edge that was termed the "lower" edge when the container was in the closed position). Upward deployment of the side panels into an elevated horizontal position is shown, for example, in FIG. 7, steps 1 through 3.

Extendible Shade Elements

The shaded area provided by the top panel and raised side panels is further maximized by incorporating supplemental, extendable shade elements that can be deployed from the raised side panels. Various configurations of these extendable shade panels can be incorporated. The mechanical design of these supplemental shade panels is not particularly limited. The supplemental extendible shade panels can be of any suitable design that can extend, swing, rotate, slide, open, attach, pivot, hinged, roll/unroll, fold/unfold, unfurl, spread, or elongate relative to the raised side panels. One of skill recognizes that a variety of functionally equivalent designs for the extendable shade elements can be used.

Recessed Extendable Shade Elements

In some embodiments, extendable shade elements are recessed within the side panels. When the shade container is in the closed storage mode, the extendable shade elements are sandwiched between the internal and external faces of the side panels, and are visually hidden within the side panels. After the upwardly pivoting side panels are raised to their open, horizontal position, the extendable shade elements are deployed by pulling them outward from an edge of the side panel. A side panel can comprise either one or two internal extendible shade elements. In some embodiments, a single side panel comprises two such extendable shade elements which deploy from opposite edges of the raised side panel, and thereby significantly increasing the amount of shaded area below the structure. For example, see FIGS. 1B and 1C, side panel 140 with extendible shade elements 170 and 171. Similarly in that same figure, see side panel 142 with extendible shade elements 172 and 173.

In some embodiments, the pull-out extendable shade elements are on a track system within the side panel, and where the track system can optionally incorporate any type of rollers, wheels or ball-bearings to facilitate deployment of the pull-out shade. In other embodiments, the extendable shade system uses a Teflon track system to facilitate the sliding of the shade. The materials used to form the extendable shades are not limited, and can be any combination of materials. For example, an extendable shade can be formed from any suitable metal alloy, such as alloys of steel or aluminum. The extendable shade can be constructed from various parts, such as a frame formed from steel or aluminum, in conjunction with a lighter shade material that is strung within the frame, such as a fabric or a suitable synthetic material such as nylon or a plastic. The extendable shade element can be any suitable material such as metal sheeting such as corrugated tin or aluminum or steel, composite materials such as panels formed from ALUCOBOND® aluminum composite materials, a pliable fabric type of material, or can be a more rigid material such as a plastic, such as PVC.

Non-Recessed Extendable Shade Elements

In some embodiments, the extendable shade elements are installed on one external face of the upwardly pivoting side panels. These extendable shade elements are not recessed within the side panels. Instead, they are installed on an exterior face of the side panel in a manner that permits them to slide inward and outward relative to one side edge of the side panel.

When the shade container is in the closed storage mode, the shade element is coplanar and overlapping the external face of the side panel, and essentially is situated on top of one face (the external face) of the side panel. After the upwardly pivoting side panel is raised to the open, horizontal position, the extendable shade element is deployed by pulling it outward along one edge of the side panel.

Figure 16:
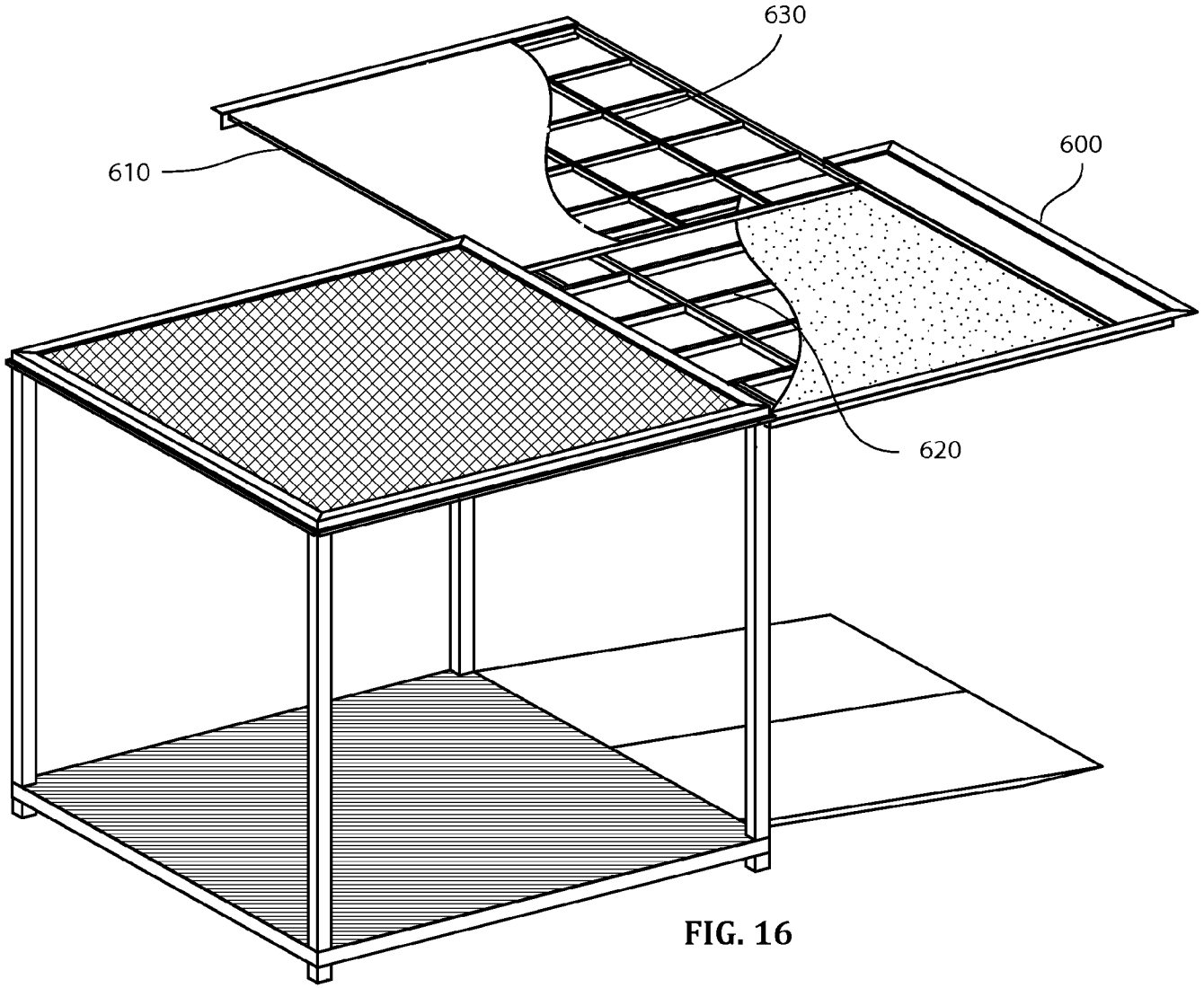
FIG. 16 provides a cut-away, perspective view diagram of a shade container containing one vertical panel that is in the open deployed position, and further where one sliding extendable shade element has also been deployed to the open position. A portion of the covering materials used in the side panel and the extendable shade element have been cut away to reveal the underlying structural supports.

This type of surface-mounted extendible shade system is shown in FIGS. 16 and 17A through 17E. FIG. 16 provides a cut-away, perspective view of a shade container containing one side panel 600 that is in the open deployed position, and where that side panel 600 contains one external mounted extendable shade element 610. In that figure, the one sliding extendable shade element 610 has also been deployed to the open position by sliding laterally away from one edge of the raised side panel 600. A portion of the sheathing materials used in the construction of the side panel and the extendable shade element have been cut away to reveal the underlying structural supports. The structural support framework of the side panel 620 and the structural support framework of the extendible shade element 630 are shown.

A side panel can comprise either one or two externally-mounted extendible shade elements. FIG. 16 shows a side panel 600 that contains only one extendable shade element 610.

Figure 17C:
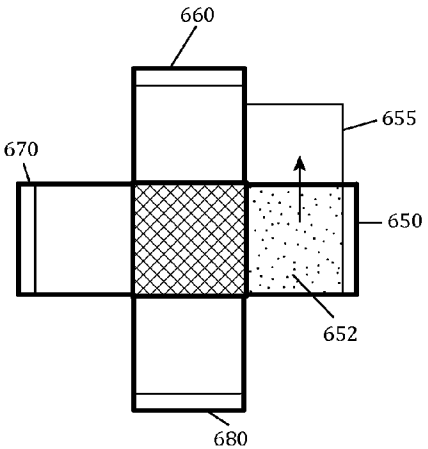
FIGS. 17A through 17E provide top-view illustrations and a perspective view of the deployment of a shade container that contains four side panels where each panel contains one extendable shade element that is deployed by sliding from a side edge of the panel.
Figure 17B:
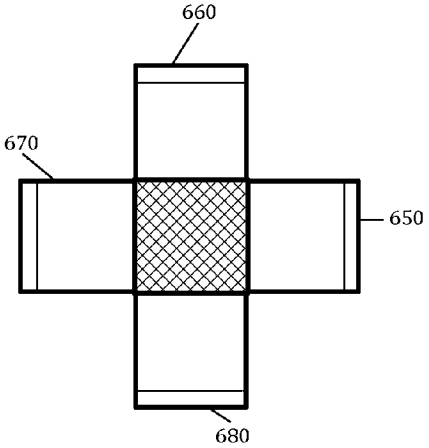
Figure 17A:
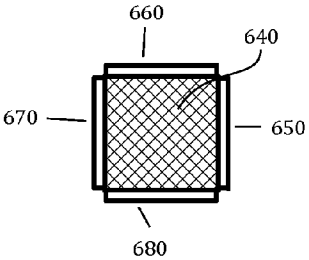
Figure 17E:
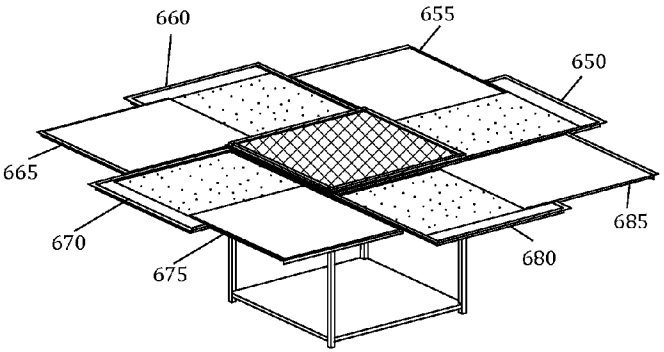
Figure 17D:
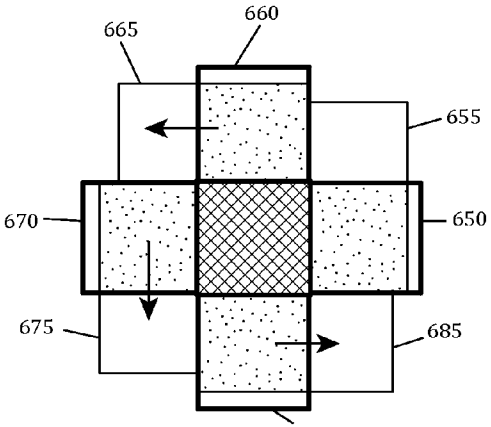

FIGS. 17A through 17E provide top-view illustrations and a perspective view of the deployment of a shade container that contains four side panels, where each side panel contains one externally-mounted extendable shade element that is deployed by sliding away from the side panel on which it is installed. FIGS. 17A-17D show top views of the shade container in the process of deployment. FIG. 17A shows the container in the closed position, where the ceiling panel 640 and the closed profiles of the four vertically-oriented side panels 650, 660, 670 and 680 are visible in their close position. FIG. 17B shows the container in the partially open position, where the four side panels 650, 660, 670 and 680 have been raised to the horizontal position that is substantially coplanar with the ceiling panel 640. FIG. 17C shows the container in partially open position, where the four side panels 650, 660, 670 and 680 are raised, and where the externally-mounted extendable shade element 655 from side panel 650 has been slid in the direction of the arrow as shown into the open shade position, thereby revealing a previously unexposed surface of the side panel 652. FIG. 17D shows the container in the fully open position, where the remaining externally-mounted extendable shade elements 665, 675 and 685 mounted to side panels 660, 670 and 680, respectively, have been slid in the direction of the arrows as shown into the open shade position. FIG. 17E shows a perspective view of the fully open shade container of FIG. 17D. In this design configuration, each of the extendable shade elements 655, 665, 675 and 685 are mounted to their respective side panel so that they all deploy in the same counterclockwise direction (as viewed from above) in order to maximize shade coverage.

In various embodiments, the externally-mounted extendable shade elements are on a track system that is installed on one external face of the side panel. The track system can optionally incorporate any type of rollers, wheels or ball-bearings to facilitate deployment of the pull-out shade. In other embodiments, the extendable shade system uses a Teflon track system to facilitate the sliding of the shade. The materials used to form the extendable shades are not limited, and can be any combination of materials.

Downward Pivoting Side Panels and Ramps

In other embodiments, one or more side panel can be designed to be lowered downwards, for example, by using a hinge mechanism that connects the lower edge (i.e., bottom edge) of the side panel to a bottom portion of the container, which can be either a bottom portion of the rigid frame or the floor panel that is fixed to the frame. Thus, the top edge of this side panel can be lowered to bring the side panel to a substantially horizontal configuration that is substantially coplanar with the floor panel. In this manner, one or more side panel can be lowered. These downwardly pivoting side panels can be used to form a platform or stage area adjacent to the container, can be used as ramps that facilitate entering and exiting the container, and/or can be lowered to directly couple the shade container to a second adjacent container. See Example 2 describing a type-2 shade container comprising at least one downwardly pivoting side panel.

Ramps used in conjunction with the shade containers find a variety of uses with the invention, and can be any one of a variety of designs. When used in conjunction with the invention, ramps can facilitate a person's safe entry and exit from a deployed shade container, and/or facilitate moving equipment into or out of a container. Any deployed shade container can utilize one or a plurality of ramps.

Figure 2B:
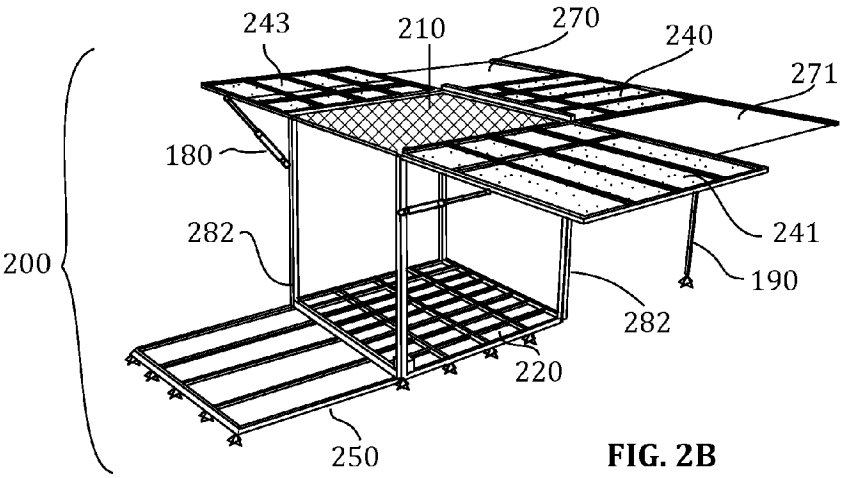
FIG. 2B provides a perspective view diagram of a type-2 shade container 200 in the fully open deployed position.

In some embodiments, a ramp can be formed by a side panel that is rotatably fastened along its bottom edge to a horizontal lower portion of the rigid frame, i.e., a type-2 shade container. See FIGS. 6A and 6B. In the closed position, this side panel 250 is in the vertical position (FIG. 6A) moveably disposed around one face of the rigid frame. In the deployed, open position, the panel 250 can be lowered to an approximately horizontal or slightly inclined (nearly horizontal) position relative to the plane of the fixed floor panel by pivoting downwards to create a ramp (FIG. 6B). The side panel then functions as a ramp after it is lowered into position. Similarly, this type of downwardly rotatable side panel is shown in FIGS. 2A and 2B, where in the closed position, this side panel 250 is in the vertical position (FIG. 2A) moveably disposed around one face of the rigid frame. In the deployed, open position, the panel 250 can be lowered to an approximately horizontal or near horizontal position to create a ramp In some embodiments, where the container is used on level ground, the floor panel is elevated a small distance above the level of the ground, for example, elevated by about 2 to 6 inches relative to the ground. The side panel can be lowered to a position below true horizontal to meet the level of the ground, thereby creating a ramp that leads up to the level of the floor panel; this feature is particularly advantageous where the supporting ground is uneven and the floor panel of the container is significantly elevated relative to the level of the ground. For example, see FIGS. 2B, 6B and 10A-10D. Optionally, the side panel can be constructed to incorporate a slight incline into its structure in order to more effectively function as a ramp.

In other aspects, a suitable ramp can be entirely free and detachable from the shade container structure, and is simply positioned adjacent to the container floor panel and dropped into position after the container is deployed. For example, see FIG. 7 (Step 5), which uses two ramps 310, and FIG. 10B container 100 which also uses at least two ramps 310 which are dropped into position in the direction of the arrows. When this style of ramp is used, the ramp is functionally coupled with the container when the proximal edge of the ramp is abutting the container floor panel or lower horizontal portion of the rigid frame.

In other designs, a ramp finding use with the invention can be recessed within or below the bottom panel of the container. When the container is in the closed position, the ramp is concealed and stored within or below the bottom panel. To deploy the ramp in the open container position, the ramp can be accessed through one edge of the bottom panel, and pulled outward in order to extend the ramp.

In some embodiments, one or more face of the shade container can contain both an upwardly pivoting side panel and a downwardly pivoting side panel. In this configuration, the top edge of the upwardly pivoting side panel is rotatably connected to a top fixed portion of the container (such as to a top portion of the rigid frame or the top panel), and the bottom edge of the downwardly pivoting side panel is rotatably connected to a bottom fixed portion of the container (such as to a bottom portion of the rigid frame or the floor panel). Upon deployment, one of the panels rotates upward, and the other panel rotates downward. When two side panels are installed on one face of the container, the panels can be configured to nest together in the closed position, such that both panels are fully folded into vertical positions when the container is in the closed position. When there are nested side panels, it is contemplated that when the container is in the closed position, one of the panels, such as the downwardly folding panel, can optionally assume a horizontal position inside the container (i.e., folded parallel and adjacent to either the fixed top panel or fixed bottom panel).

In other aspects where one face of a shade container comprises both an upwardly pivoting side panel and a downwardly pivoting side panel, i.e., two nested side panels, it is not required that both panels have the same dimensions. For example, both panels need not be the same height as the container, and one panel can be a different height or width as the other panel.

Where a shade container comprises both an upwardly pivoting side panel and a downwardly pivoting side panel on the same face of the container, the downwardly pivoting side panel can be optimally designed for use as a ramp that is lowered into the horizontal or near horizontal position. For example, the ramps can optionally be integrated into the container as downwardly pivoting side panels that are rotatably attached at their bottom (proximal) edge to the fixed bottom edge of the rigid container frame or to the container floor panel.

In still other embodiments, a panel that is to be used as a ramp can be rotatably attached along its proximal edge to a fixed portion of the container in a manner that permits that ramp panel to be raised past the vertical position and fold inward all the way to the floor of the container and lay flat against the floor panel when the container is in the closed position.

Is some embodiments, the rigid frame and the side panels that are attached to the frame can be of metal construction, such as steel, although other metals are contemplated, such as aluminum, which offers the advantage of lighter weight. Still other materials such as any type of metal alloys, wood and PVC are also contemplated. In some embodiments, the containers are of hybrid construction that uses two or more materials in the construction of the containers. It is not intended that the invention be limited to any particular construction material or combination of materials.

Figure 12:
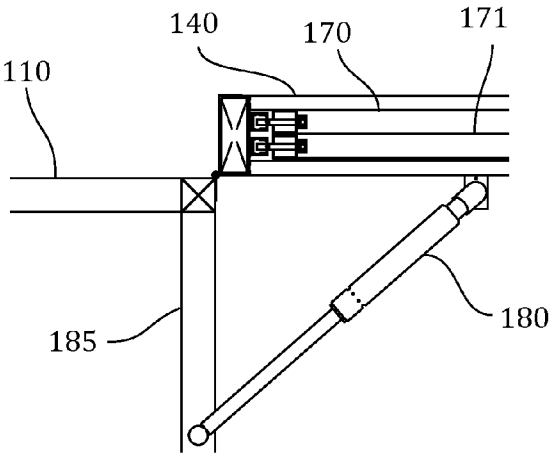
FIG. 12 provides a cross sectional view of a hydraulic arm 180 that is connected at one end to a pivoting side panel 140 and at the opposite end to an immobile (fixed) portion 185 of the shade container, such as a section of the container rigid frame.

In some embodiments, a side panel that is non-fixedly attached to the rigid frame of the container, including both downwardly pivoting and upwardly pivoting side panels, is optionally fitted with one or more pulley system that facilitates the raising and lowering of the side panels. See the pulley system 255 in FIGS. 6A and 6B. This can be particularly advantageous when the side panels are of substantial weight. Similarly, any side panel can optionally be fitted with one or more hydraulic arm to lock the upwardly rotating side panel into the elevated horizontal position and facilitate raising and lowering of the side panel, thereby increasing safety for the operator. One or more hydraulic arm can also be used with the downwardly rotating side panel, where the hydraulic arm will control the rate of lowering of a heavy side panel, thereby preventing the side panel from falling immediately to the ground and improving operator safety. Detail of a hydraulic arm system is shown in FIG. 12. Such a hydraulic arm system can be attached at one end to the pivoting side panel and at the opposite end to an immobile, fixed portion of the container, such as to a portion of the rigid frame.

Type-1 and Type-2 Shade Containers

The present disclosure provides detailed descriptions of various embodiments of the shade containers of the invention, for example, as described in the Examples. These include, but are not limited to, the type-1 and type-2 shade containers.

In some aspects, a type-1 shade container contains, most generally, at least one side panel that rotates upwards into an elevated horizontal position on a hinge mechanism, thereby forming a shaded environment below, and further, does not contain any downwardly rotating side panels. In other embodiments, a type-1 shade container contains four side panels that each rotate upwards on a hinge mechanism, thereby forming the shaded environment below. In addition, either one or two of the upwardly rotating side panels in a type-1 shade container can optionally contain two additional slide-out shade inserts, thereby further enhancing the shaded area below the structure.

The present disclosure also describes a second type of container, termed a type-2 shade container. Most generally, a type-2 shade container comprises at least one side panel that rotates downwards on a hinge mechanism into a horizontal position that is adjacent to the ground or floor level. In some embodiments, a type-2 shade container comprises the downwardly rotating side panel, and additionally, either one, two or three side panels that rotate upwards. Optionally, at least one of the upwardly-rotating side panels contains two additional slide-out shade inserts. In some embodiments, a type-2 container can comprise two downwardly-pivoting side panels, for example, on opposite faces of the container.

Shade containers of the invention are not limited to the particular embodiments described herein. Although various embodiments of the type-1 and type-2 shade containers are described in detail in the Examples, drawings, and detailed description of the invention, it is not intended that the invention be limited to shade containers having these structures. One of skill will recognize that a shade container of the invention can be customized to any desired configuration, and can contain any number or combination of upwardly pivoting side panels, downwardly pivoting side panels, and supplemental extendable (sliding) shade elements. The design of a shade container can be optimized based on intended use. In still other embodiments, a shade container of the invention can comprise one or more fixed side panels that do not rotate in any aspect.

In still other aspects, the shade containers of the invention can be used in partially-deployed positions. For example, a type-1 shade container containing four upwardly rotating side panels can be used by deploying only a subset of the four upwardly rotating side panels, such as only one panel, two panels or three panels. It is not intended that all four side panels of a type-1 shade container be raised for the deployed shade container to find use. Deployment of fewer than all four of the side panels may be optimal in situations such as where there is confined space to set up the shade container, in situations where protection from wind or rain is desired, in situations where the user may want some degree of privacy, or in situations where multiple shade containers are adjacent to each other or otherwise coupled together.

Shade Container Modifications

In some embodiments, the shade containers of the invention further contain electrical conduits and suitable electrical outlets and/or electrical connection inputs to permit electrical service inside the deployed container. For example, the interior of the container and/or the structural framework of the container can contain electrical wiring, outlets installed on the inside or outside of the container, circuit breakers, and control switches to regulate the distribution of the power to the various outlets or hardwired fixtures.

With such wiring, the container can be connected to a suitable external power source, for example, a portable AC electric generator or a live AC power input. Suitable input connectors to accept the external power source can also be installed on the inside or outside of the containers. Alternatively, the container can be adapted to house its own DC battery power supply that can provide power to electrical systems that are connected to the container.

Distributed AC or DC current in the container distributed to electrical outlets to hardwired electrical devices finds a variety of uses, for example, to power smoke detectors, cooking equipment, first-aid equipment, hear or air conditioning. In some embodiments, electrical power to the container finds particular use in powering an internal lighting system of any suitable type within the container. A lighting system can comprise internal wiring, light fixtures of any suitable type, and switches to control the lighting.

In still other embodiments, the containers of the invention can optionally be fitted with plumbing conduits. For example, such plumbing can be used to provide running water within the shade container when the plumbing is connected to a suitable external water supply. Alternatively, the shade container can contain its own independent water tank to supply water within the open shade container through the integrated plumbing system.

In still other embodiments, plumbing conduits and/or pipes and/or tubing is installed within the container or container structural framework for the distribution of gasses within the container, for example, such as oxygen, as might be useful when the containers are to be used as a first aid station or mobile medical facility. In other embodiments, piping for the distribution of propane or natural gas also finds use with the invention where the containers are adapted for cooking, food preparation, catering, or any type of food services. A piping system to distribute propane or natural gas and conduits to distribute electrical power can also be adapted to power suitable heating systems or air conditioning systems.

In still other embodiments, the rigid container frame and other components of the shade container can incorporate channels or piping or tubing to allow the drainage of rain water.

Modular Shade Systems

In other embodiments of the invention, a plurality of shade containers are used in concert to create larger multi-container shade structures. Two or more shade containers act as modules to construct the multi-unit modular shade systems. This can be accomplished by using any of a variety of methods.

It is contemplated that any two or more shade containers can be functionally coupled to form a modular shade system. Two or more shade containers are functionally coupled when they are joined, abutted, directly connected or indirectly connected by supplemental materials, such as by an overhead fabric shade system like a roller shade. When the two or more shade containers are functionally coupled by the use of supplemental materials such as by fabric shade material spanning from one container module to a second container module, one end of the supplemental shade material is fastened to the first container, and the opposite end of the shade material is attached to the second container module.

I. Direct Coupling of Shade Container Modules

Figure 14C:
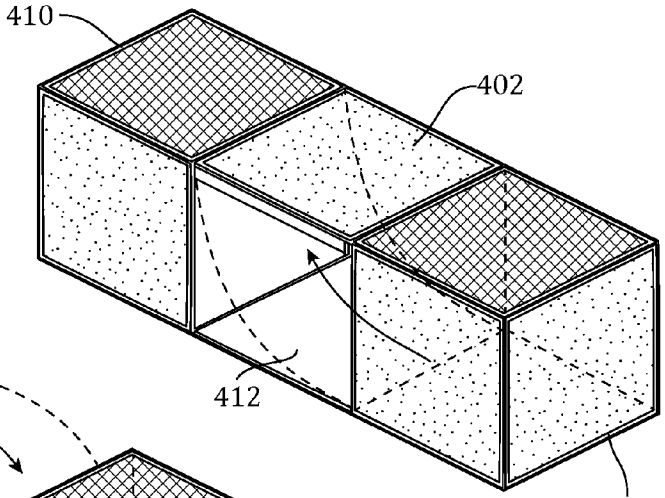
FIGS. 14A through 14F provide illustrations demonstrating the step-wise assembly of a modular shade system that is formed by the direct physical coupling of two shade modules directly to each other.

In one embodiment, modular shade systems utilizes at least two adjacent shade containers that are directly coupled to each other to form the larger shade structure, as described in Example 5. One example of this direct coupling of shade containers is shown in FIG. 14C. This type of modular shade system does utilize any type of supplemental materials (such as fabric shades) that span the distance between two or more containers. This direct coupling system uses only the shade containers themselves to create the sheltered area.

Figure 14B:
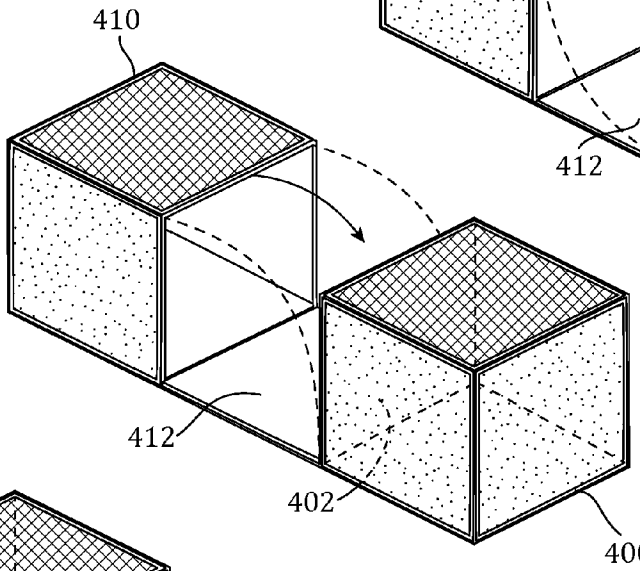
Figure 14A:
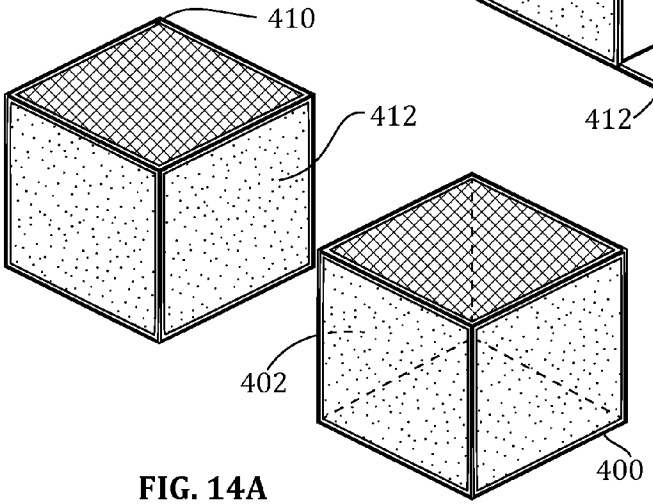

FIGS. 14A through 14C provide illustrations demonstrating the step-wise assembly of a sheltered area that is formed by direct coupling two shade modules directly to each other. These figures provide one possible configuration of a direct-coupling shade system that incorporates a first container that is a type-1 shade container and a second container that is a type-2 shade container. As shown in the figures, the assembly of this type of shade system is accomplished by functionally coupling two shade modules directly to each other, simultaneously forming an overhead panel and a floor panel in the same sheltered section.

As shown in FIG. 14C, the distal edge of a upwardly pivoting side panel in the first container in the open position (i.e., the edge of the panel that is furthest from the container frame) abuts the face of the adjacent second container at a position at or near the top panel of the second container, or alternatively, can contact an upper horizontal section of the rigid frame of the second container. Similarly, the distal edge of a downwardly pivoting side panel in the second container in the open position abuts the face of the adjacent first container at a position at or near the bottom panel of the first container, or alternatively, can contact a lower horizontal section of the rigid frame of the first container.

After these panels are placed into their horizontal positions and abutting the respective adjacent container, they can optionally be fastened into place by any suitable means for temporarily securing the distal edges of the horizontal panels to the adjacent container, for example, such as by using any suitable type of hook, latch, bracket, fastener, nut and bold assembly, pegs or pins.

Figure 1B:
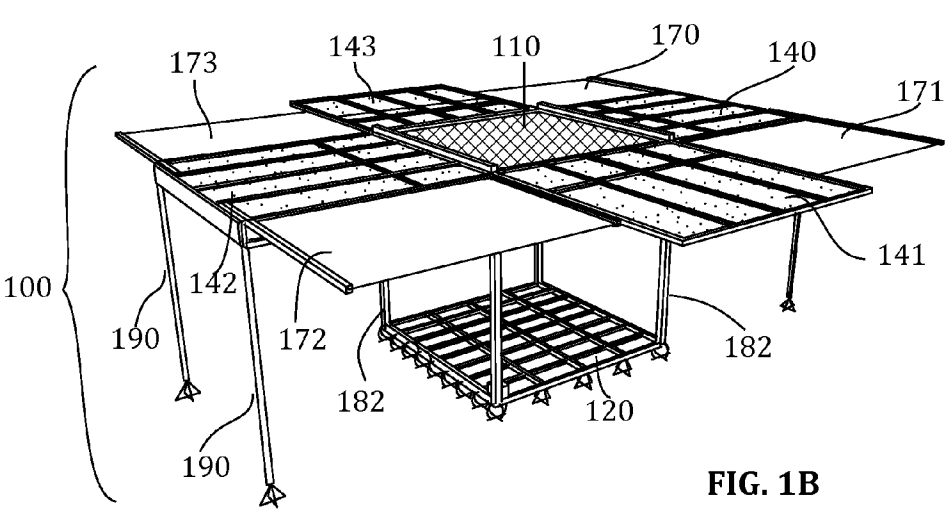
FIG. 1B provides a perspective view diagram of a type-1 shade container 100 in the fully open deployed position.

As shown in FIG. 14C, after the side panels of two adjacent shade container modules are raised and lowered, respectively, into position, a protected area between the two containers is created, where the protected area comprises a top ceiling panel formed from a first container and a bottom floor panel formed from a second container. Furthermore, the shade container modules can each further comprise additional side panels that can be raised to further extend the shaded area, or lowered to form ramps or platforms. Furthermore still, a side panel that is upwardly pivoting as used in the present embodiment can optionally comprise extendable shade elements that can be deployed from within the side panel, for example, as depicted in FIGS. 1B and 1C.

It is not intended that this aspect of the invention describing direct-coupling of shade container modules to form multi-container shade systems be limited to the design shown in FIGS. 14A-14C. For example, it is not intended that the invention be limited to the functional coupling of one type-1 shade container and one type-2 shade container to construct the shade system. For example, two type-1 shade containers can be functionally coupled in a manner similar to that described in Example 5, where the distal edges of two opposing raised side panels from the two adjacent containers in the open position can be joined along their distal edges to create a shaded area twice as large as the shaded area shown in FIG. 14C (but without creating a floor panel). The functional coupling can be by any suitable method such as simply abutting the edges of the raised panels, or by any suitable fastening means. Furthermore, arrays of three or more shade containers can be functionally coupled in the manner described in Example 5 to form still larger higher-order shade structures, for example, analogous to the arrays of three or more shade structures shown in FIGS. 9A and 9B.

II. Indirect Coupling of Shade Container Modules

In other embodiments, higher order shade structures comprising two or more functionally coupled shade containers can also be constructed by the use of supplemental shade elements that can span the distance between two containers, and where the containers serve as the anchors for the supplemental shading materials. This indirect functional coupling of shade container modules can use any number of type-1 or type-2 shade containers. In these embodiments as described in Example 3 (Tandem Modular Shade Systems) and Example 4 (Extended Modular Shade Systems), the sheltered areas include not only the areas directly beneath the containers, but also includes larger sheltered areas that lie between the two containers and below the supplemental materials that are attached to and spanning the distance between the containers.

The use of two shade container modules and supplemental shading materials suspended between the modules to construct a tandem shade system is described in Example 3. Most generally, the supplemental shading material that is used to functionally couple the two shade container modules can be any suitable shading material, and can be either flexible, fabric-type of material such as canvas or nylon, or can be more rigid, such as rigid panels of wood or sheets of corrugated tin or aluminum, or a synthetic material such as plastic or fiberglass.

When a fabric-type material such as canvas is used, it is preferably incorporated into a rolling shade, where the fabric can be conveniently coiled around a spool to facilitate deployment into an open position and disassembly into a closed position. A roller shade can be hand operated or motor driven. The shade material fabric roll that has been wound onto a spool or roller mechanism can be contained and protected in a housing that is installed on a first container module. The roller shade and/or roller shade housing can be installed on top of the fixed top panel of a container, to a top portion of the rigid frame, or can be installed anywhere on the container that will be suitably oriented and elevated when the container is in the open position so that after deployment of the shade element, the shade element is horizontally oriented and can provide a shaded area below.

To deploy the roller shade system, one end of the shade material is unwound from the rolling mechanism and extended towards the second container module, where the extended end of the roller shade will be attached to the second container using any suitable attachment means, for example, by any combination of hooks, eyelets, rings, loops, or the such, that can be installed on the end of the fabric shade material and mated with a suitable complementary fastening means that is installed on the second shade container module.

In one embodiment, for example, as shown in FIGS. 8A-8D and 10A-10D, a first shade container is fitted with a rolling shade element 320, consisting minimally of any suitable flexible shading material, such as a canvas fabric, which is wound into a fabric roll 330. The rolling shade housing 340 and motor 350 are installed on the fixed top panel of the first container. The fabric shading material is extended from the top of the first shade container to the top of a second shade container. The shade material is then attached to the second shade container by any suitable coupling system. Using this technique, two or more shade units are interconnected and functionally coupled to provide shade areas that encompass not only the shade areas provided by the shade containers themselves, but also includes the area that lies between two or more appropriately positioned containers underneath the supplemental roller shade.

Figure 9A:
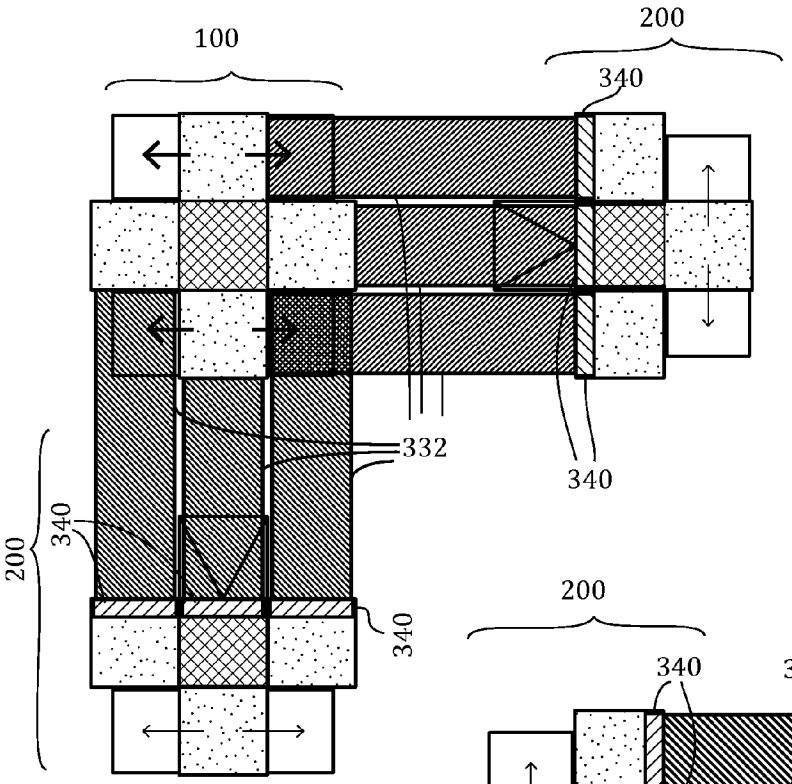
FIGS. 9A and 9B provide illustrations demonstrating the simultaneous use of three shade containers in a modular system to construct large sheltered areas, where rolling shade elements are used in conjunction with the three shade containers. The system depicted in FIGS. 9A and 9B uses one type-1 shade container and two type-2 shade containers.
Figure 9B:
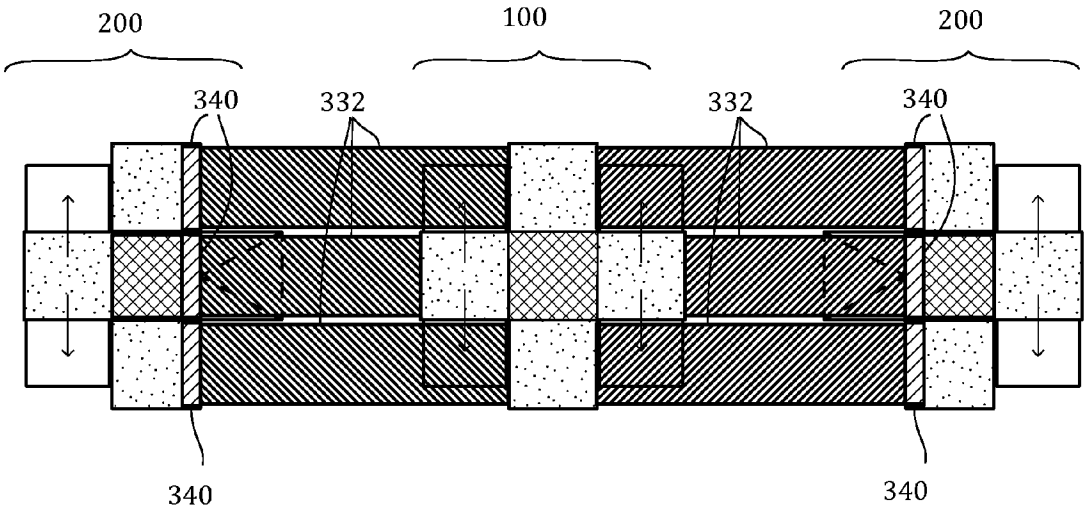

Another advantageous use of the type-1 and type-2 shade containers is in the design of extended modular shade systems that use three or more shade containers to construct an extended, higher-order shaded area, as described in Example 4. The design and application of these extended systems is similar to the tandem shade systems described in Example 3, except that the extended shade system incorporates three or more shade containers. FIGS. 9A and 9B provide illustrations demonstrating two embodiments of extended modular shade systems of the invention. It is not intended that the invention be limited to the configurations shown in FIGS. 9A and 9B, as one will recognize that the modular system of the invention is highly adaptable to permit customization in the design of extended shade structures containing three or more container modules.

Additional aspects of the invention are further described in the EXAMPLES and descriptions of the drawings, as provided below.

EXAMPLES

The following examples are offered to illustrate, but not limit, the claimed invention. It is understood that various modifications of minor nature or substitutions with substantially similar components or materials will be recognizable to persons or ordinary skill in the art, and these modifications or substitutions are encompassed within the spirit and purview of this disclosure and within the scope of the invention.

Example 1

Design of a Type-1 Shade Container

This example describes the design of a type-1 shade container. A type-1 container is characterized by a fixed top panel, a fixed bottom panel, and four pivoting side panels that each rotate upwards to a horizontal position, and further where two of those pivoting side panels (which are on opposite faces of the container) comprise two extendable, pull-out shade elements.

Figure 1A:
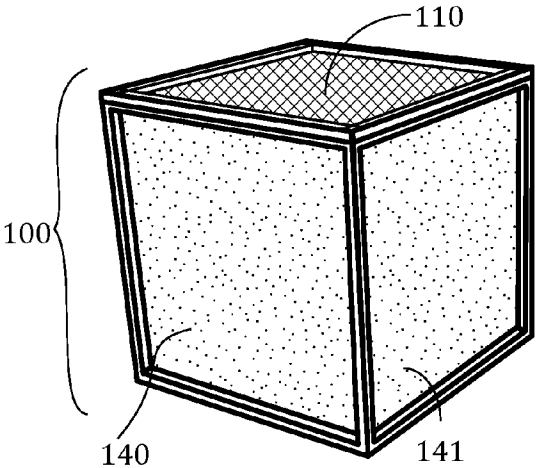
FIG. 1A provides a perspective view diagram of a type-1 shade container 100 in the fully closed position.
Figure 1C:
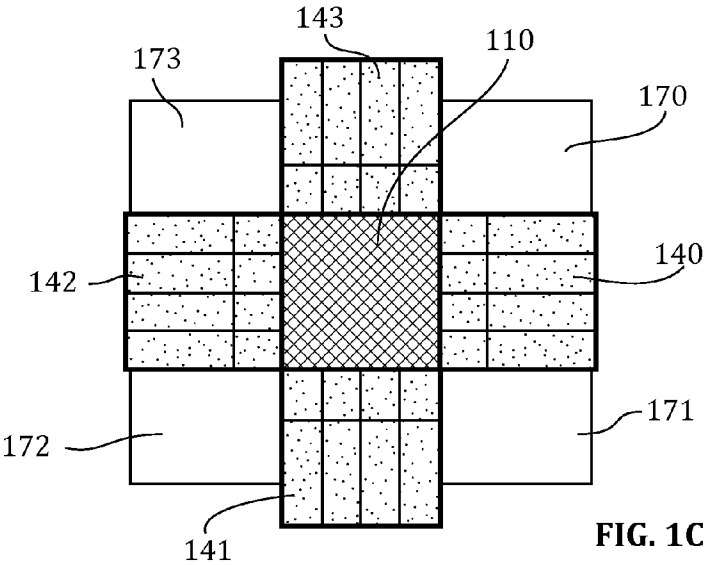
FIG. 1C provides a top view diagram of a type-1 shade container in the fully open deployed position.

Perspective views of a type-1 shade container 100 are shown in FIGS. 1A and 1B, in the closed and open positions, respectively. Lateral cross sectional views of a type-1 shade container 100 in the closed position are provided in FIGS. 3A and 5A. Lateral cross sectional views of a type-1 shade container 100 in the open position are provided in FIGS. 3B and 5B.

Figure 3A:
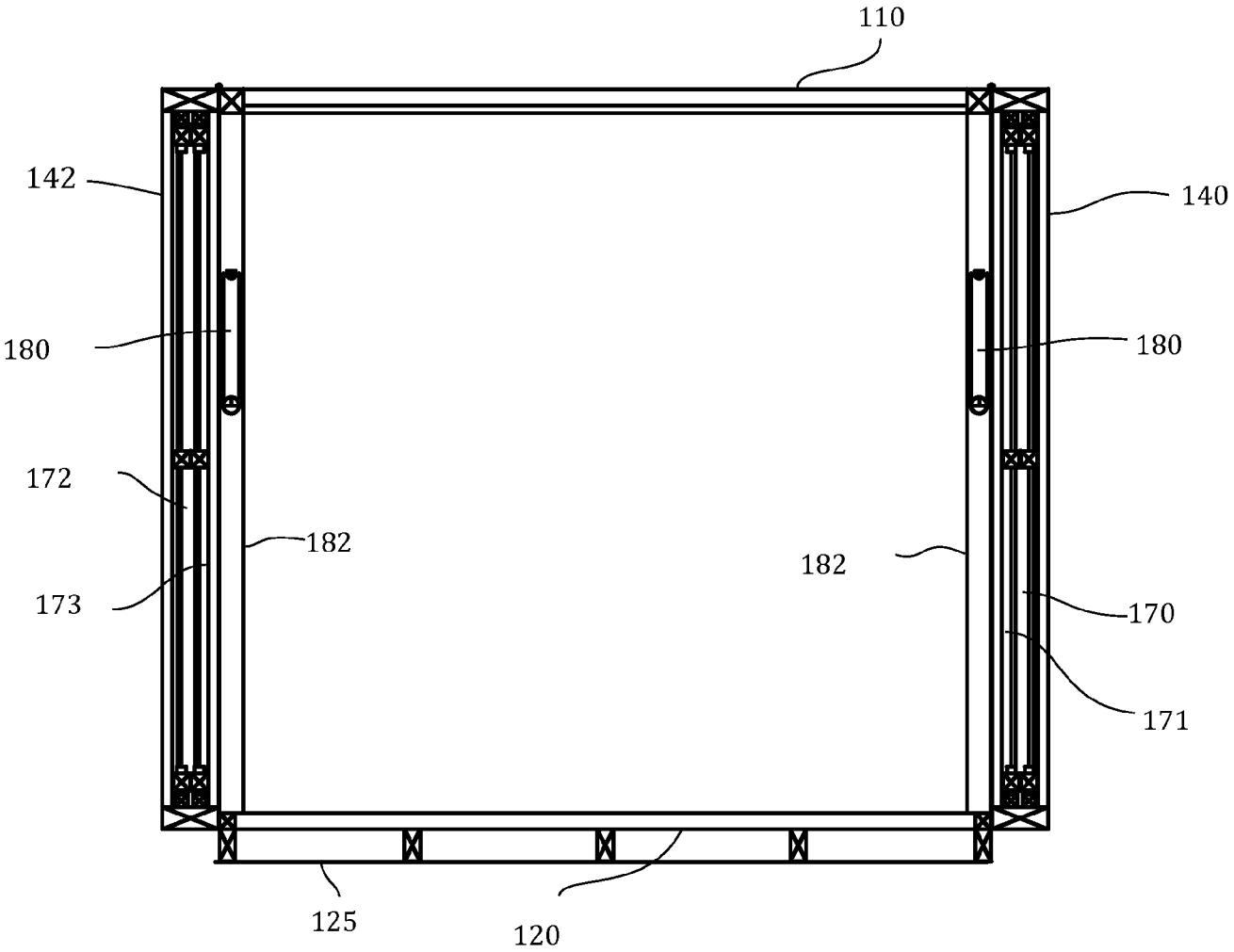
FIG. 3A provides a lateral cross sectional view of a type-1 shade container in the fully closed position, where the lateral cross section transects, among other elements, two upwardly rotating side panels 140 and 142, where each of those side panels contains two supplemental extendable shade elements.
Figure 5A:
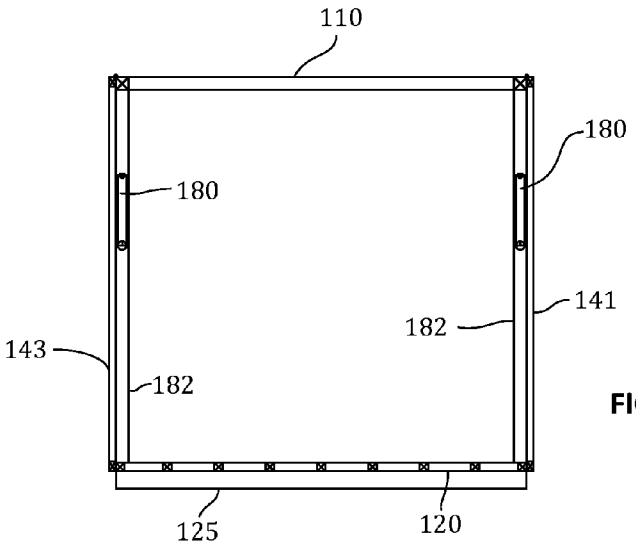
FIG. 5A provides a lateral cross sectional view of a type-1 shade container in the fully closed position. This cross sectional view transects, among other elements, two pivoting side panels 141 and 143 that do not house any extendable shade elements.
Figure 6A:
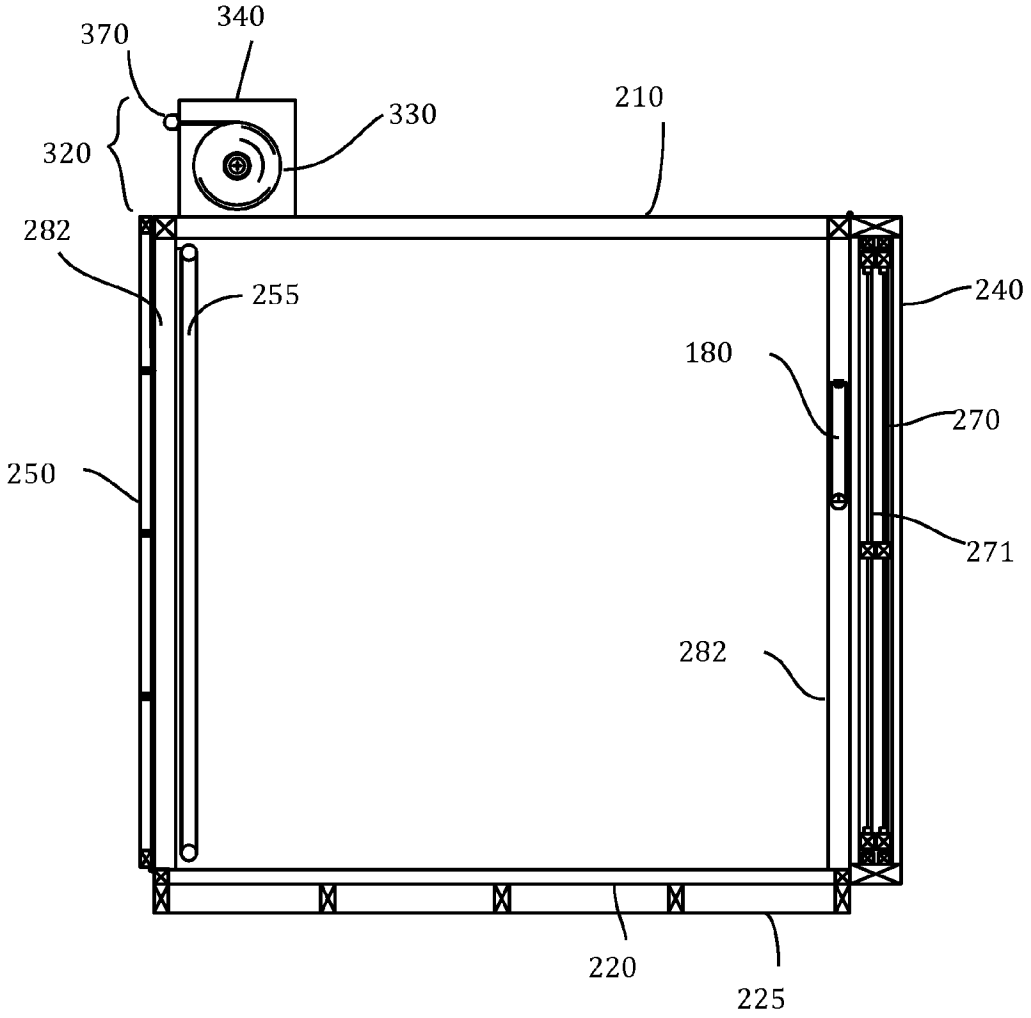
FIG. 6A provides a lateral cross sectional view of a type-2 modular shade container in the fully closed position, where this container view includes one downwardly pivoting side panel 250, one upwardly pivoting side panel 240 housing two extendable shade elements, and a rolling shade element 320 mounted to the top panel.
Figure 6B:
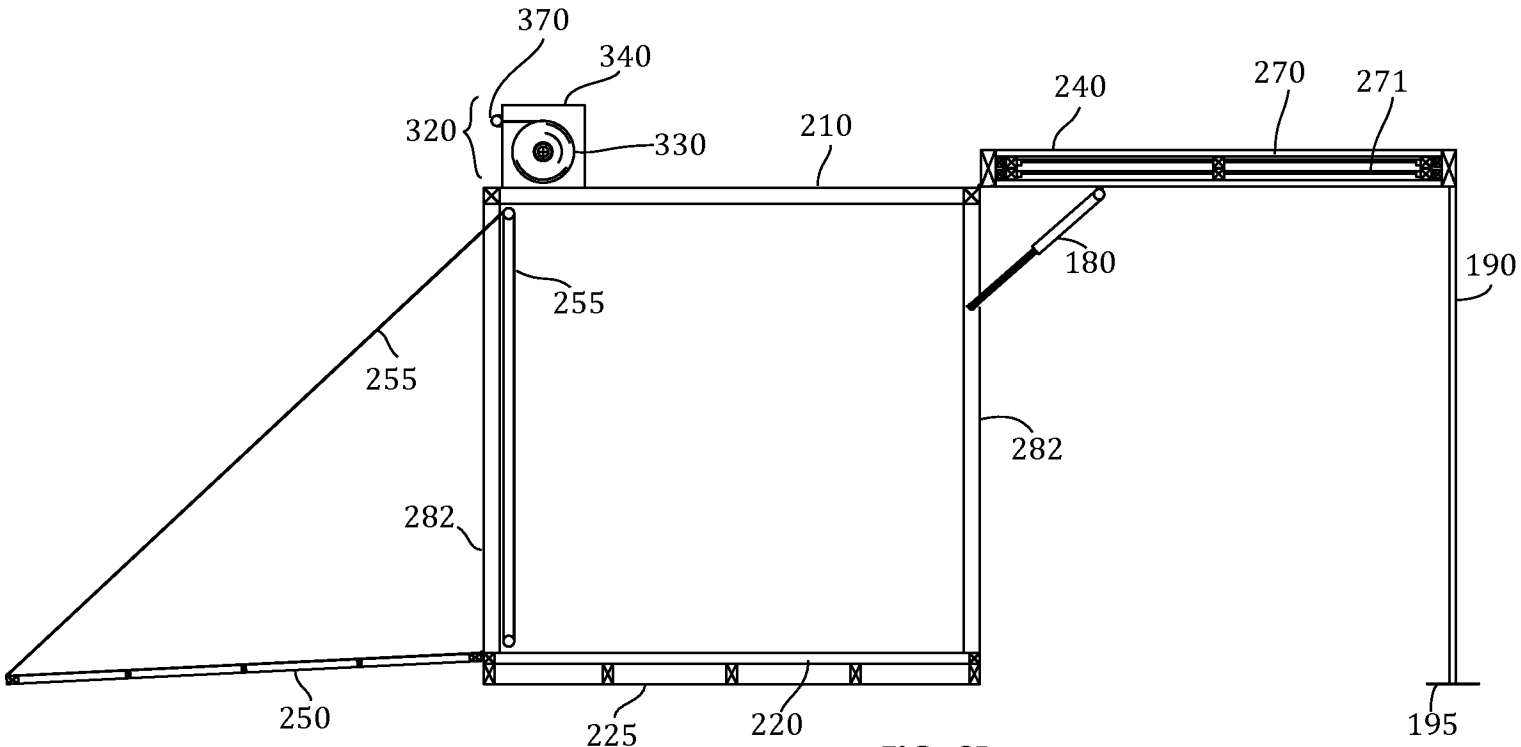
FIG. 6B provides a lateral cross sectional view of the same shade container shown in FIG. 6A, except in the fully open deployed position.

FIGS. 1A, 3A and 5A, depict a type-1 shade container in the closed position, where each of the four side panels 140, 141, 142 and 143 are folded into the structure and are in a vertical orientation. When in the closed position, these four side panels, in combination with a top ceiling panel 110 and a bottom floor panel 120 form a cube geometry (FIG. 1A). In this example, the container in the closed position is approximately 8 feet in each dimension length, width and height. In addition, the shade containers of FIGS. 3A and 5A also depict a forklift platform 125 that sits below the floor panel 120.

FIG. 1B provides a perspective view of a type-1 container 100 in the fully open deployed position. Each of the side panels of the type-1 container are upwardly pivoting side panels 140, 141, 142 and 143 (FIG. 1B). The top edges of each of the upwardly pivoting side panels are connected to the top edge of the container structural framework by a rotating fastener such as a hinge. Portions of the type-1 container rigid frame 182 are visible in FIG. 1B.

There are two types of upwardly pivoting side panels that form the type-1 shade container. One type of upwardly pivoting side panel houses two extendable shade elements within the structure of the side panel. When in the closed position, the extendable shade elements are recessed within the side panel. When one of these side panels is raised into the horizontal open position, the extendable shade elements are pulled outward from the side panel to increase the shaded area below the container. The two extendable shade elements is on a track system where the shade element can be easily pulled outward in shade mode, and then pushed back inward when the container is to be folded back into the closed cube position for storage mode. There are two such side panels 140 and 142 in the type-1 container, and they are positioned on opposite vertical faces of the container. The remaining two side panels 141 and 143 in the type-1 container do not contain any extendable shade elements, and these two side panels are installed on the remaining two opposite vertical faces of the container.

As depicted in FIG. 1B, side panels 140 and 142 each contain two extendable shade elements, where side panel 140 houses extendable shade elements 170 and 171, and where side panel 142 houses extendable shade elements 172 and 173. When side panel 140 is raised into the horizontal open position, the shade elements 170 and 171 are pulled outward from the side panel to increase the shaded area below the container. Similarly, when side panel 142 is raised into the horizontal open position, the shade elements 172 and 173 are pulled outward from the side panel to increase the shaded area below the container. FIG. 1B shows these extendable shade panels in the extended, deployed position. These supplemental shade elements are retracted within the side panels when the container is in the closed position. In the open position, upwardly pivoting side panels 141 and 143 are also raised to a horizontal position that is approximately coplanar with the fixed top panel 110. Side panels 141 and 143 do not contain any extendable shade elements.

Figure 4:
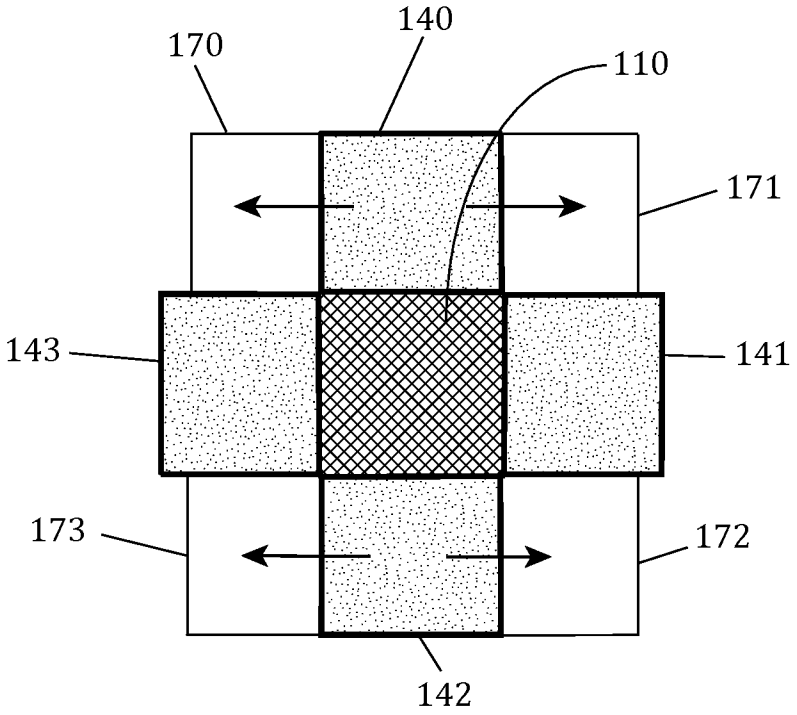
FIG. 4 provides a top view diagram of a type-1 shade container in the fully open deployed position, where the view includes the container top panel, four upwardly pivoting side panels, and four extendable shade elements that are deployed from within two of the upwardly pivoting side panels in the direction shown by the arrows.

Top views of a fully opened type-1 container are provided in FIG. 1C and FIG. 4. As illustrated in these figures, all four upwardly pivoting side panels 140, 141, 142 and 143 are raised to a horizontal position that is approximately coplanar with the fixed top panel 110. After side panel 140 is raised into the horizontal position, the extendable shade elements 170 and 171 are pulled outward from the panel (as shown by the arrows in FIG. 4) in order to expand the shaded area below the container. Similarly, after side panel 142 is raised into the horizontal position, the extendable shade elements 172 and 173 are pulled outward from the panel (as shown by the arrows in FIG. 4). This process is reversed when the container is closed into a cube position. Side panels 141 and 143 are also raised, but do not contain any extendable shade elements. The total shaded area that is provided by the fully open type-1 container is a square approximately 24 feet on a side, that is, approximately 576 square feet.

Figure 3B:
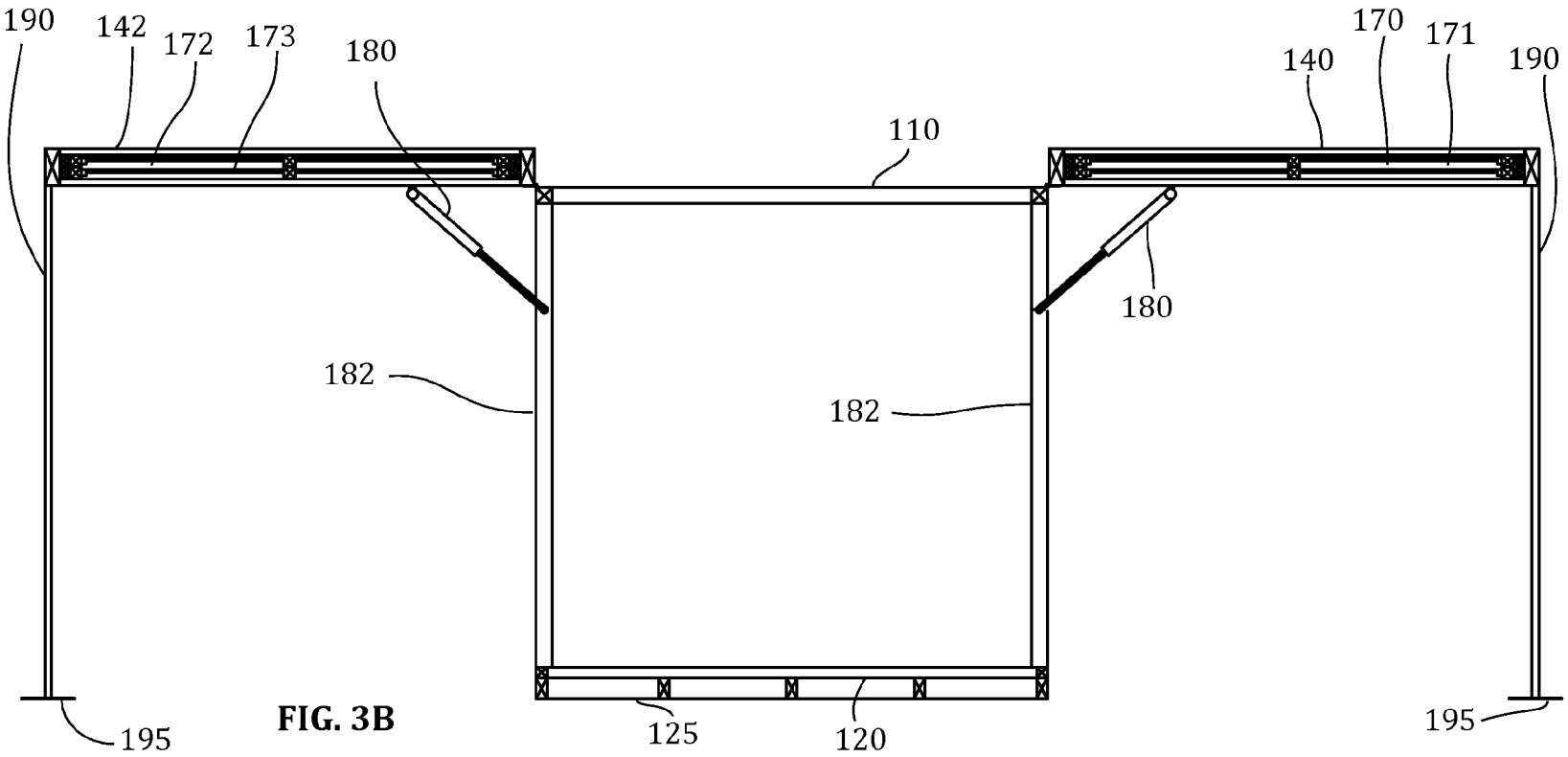
FIG. 3B provides a lateral cross sectional view of the same type-1 shade container shown in FIG. 3A, except in the fully open deployed position.

The structure and function of the side panels in a type-1 container can also be understood when viewed in lateral cross section. FIGS. 3A (closed position) and 3B (open position) show a cross section of a type-1 container where the transect crosses side panels 140 and 142 in which each of those side panels contains two extendable shade elements. As shown in these figures, side panel 140 contains extendable shade elements 170 and 171, and where side panel 142 houses extendable shade elements 172 and 173. In the closed position, side panels 140 and 142 are disposed about the rigid frame 182 of the container (FIG. 3A). In the open position, side panels 140 and 142 have been rotated to a horizontal position nearly coplanar with the top panel 110 (FIG. 3B). The upper edges of side panels 140 and 142 are the only edges of those panels that are fastened to the container, and where that attachment, e.g., by a hinge, permits rotation of the panels upwards.

Figure 5B:
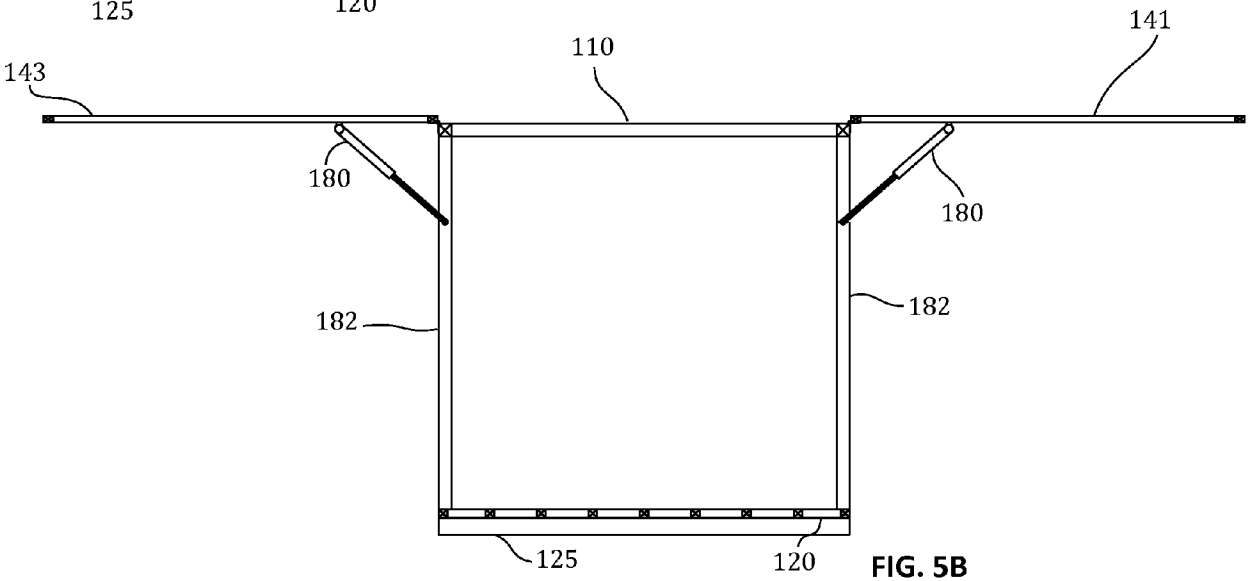
FIG. 5B provides a lateral cross sectional view of the same modular shade container shown in FIG. 5A, except in the fully open deployed position.

FIGS. 5A (closed position) and 5B (open position) show a cross section of the same type-1 container shown in FIGS. 3A and 3B, except where the transect crosses side panels 141 and 143, where those side panels do not contain any extendable shade elements. In the closed position, side panels 141 and 143 are disposed about the rigid frame 182 of the container (FIG. 5A). In the open position, side panels 141 and 143 have been rotated to a horizontal position nearly coplanar with the top panel 110 (FIG. 5B). The upper edges of side panels 141 and 143 are the only edges of those panels that are fastened to the container, and where that attachment, e.g., by a hinge, permits rotation of the panels upwards.

Figure 7:
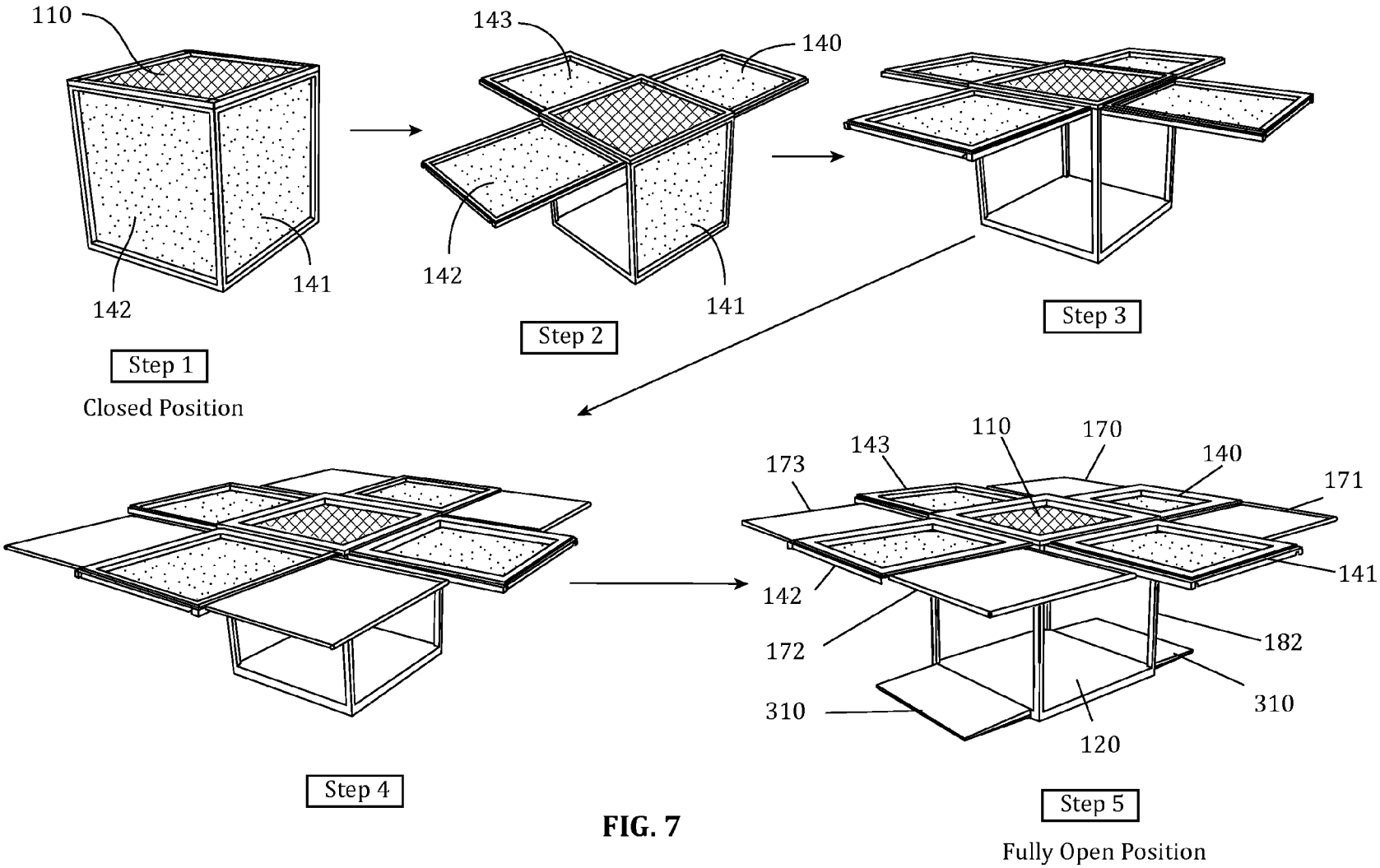
FIG. 7 provides an illustration showing the general steps of opening and deploying a type-1 modular shade container starting in the fully closed position (step 1) and leading to the fully open position (step 5). Also shown in step 5 is the use of two ramps leading to the bottom floor panel of the container.

The general steps for opening and deploying a type-1 shade container are shown in FIG. 7. Step 1 shows the fully closed position of the container, with the upwardly pivoting side panels in the closed vertical orientation (also shown in FIG. 1A). Steps 2 and 3 illustrate the process of raising each of the upwardly pivoting side panels 140, 141, 142 and 143 until all four side panels have been raised to the open horizontal position (Step 3) approximately coplanar with the top ceiling panel 110 of the container. Step 4 of FIG. 7 shows the shade container after the extendable supplemental shade elements 170, 171, 172 and 173 have been fully extended from their closed position within the walls of the two side panels 140 and 142. Step 5 shows the fully deployed modular shade container, and additionally includes two optional ramps 310 that can be positioned adjacent to the bottom floor panel 120.

The shade container is constructed around a rigid, immobile structural framework, typically constructed from steel. This is best illustrated in FIGS. 15A-15E. As shown in those figures, the rigid structural framework includes minimally four vertical sections 510 as well as four upper horizontal sections 520 and four lower horizontal sections 525. Also for example, FIGS. 1B, 3B and 5B, the rigid structural framework includes minimally four rigid, i.e., immobile, vertical sections 182 as well as top and bottom horizontal sections. In FIGS. 1B, 3B and 5B, the upper and lower horizontal sections of the rigid framework can be simple cross bars, analogous to the vertical frame sections 182, and where the top panel 110 and bottom panel 120 are fixed to that framework. Alternatively, the rigid frame can incorporate (i.e., integrate) the top panel 110 and bottom panel 120 as part of the rigid framework.

The rigid frame of the container serves as the anchor points for the side panels and other structures that are attached to the framework. For example, the upwardly pivoting side panels 140, 141, 142 and 143 are attached to a horizontal element on the rigid frame, or attached to the top panel 110, where the top panel is fixed to the rigid frame or is a component of the rigid frame. See FIGS. 3A, 3B, 5A and 5B.

When the type-1 shade container is in the open position, it can optionally utilize vertical support columns or poles 190, as shown throughout the drawings, for example, FIGS. 1B and 3B. These vertical support poles 190 are positioned at or near the two distal corners of the deployed horizontal side panels, and extend to the ground in order to provide added support to uphold the weight of the side panels and maintain the side panels in a horizontal position. As shown in FIGS. 1B and 3B, these support poles 190 can be used in conjunction with the side panels 140 or 142 containing the extendable shade elements. However, the use of support poles 190 is not limited to those panels, as they can also be used with side panels 141 or 143 that do not contain extendable shade elements. These support poles can be detachable from the container structure, and can be made in multiple short sections that can be assembled to create the full-length support pole to facilitate transportation and storage of the poles; for example, the poles can be manufactured in multiple sections that are screwed together or inserted into each other end-to-end to form the full length pole. Alternatively, the poles can be integrated into the container design such that they collapse or fold out of the way when the side panels are folded into the closed position, but remain attached to the container. The support poles can further integrate a stabilizing pole support base 195, where the end of the pole contacts the pole support base instead of contacting the ground (see FIG. 3B). A support base can take any form, including a simple metal disk into which the pole is inserted and rests upon when the pole is deployed, or alternatively, any type of small platform, a tripod structure or a weighted bucket.

The type-1 shade container can optionally include one or more hydraulic arm system 180 to support the weight of an upwardly pivoting side panel, lock the panels into the horizontal position, and to facilitate the opening and closing of the side panels, as illustrated throughout the drawings. See, for example, FIGS. 3B and 5B. See also the detail of the hydraulic arm system in FIG. 12. These hydraulic arm systems 180 can be used to support upwardly pivoting side panels 140 or 142 that contain extendable shade elements, or can be used to support upwardly pivoting side panels 141 or 143 that do not contain extendable shade elements. The hydraulic systems, as shown in FIG. 12, are attached at one end to a pivoting side panel, e.g., panel 140, and at the opposite end to an immobile structural element 185 of the container (see FIG. 12), such as a vertical support in the rigid frame 182 (e.g., FIG. 3B). A single side panel can use one hydraulic arm, or alternatively, can use two hydraulic arms, where one arm is positioned on each edge (i.e., left/right edges) of the side panel.

Example 2

Design of a Type-2 Shade Container

This example describes the design of a type-2 shade container. A type-2 shade container shares many of the design features of the type-1 shade container type-2 container, but is characterized by having fewer than four upwardly pivoting side panels, and further where at least one one of the side panels is a downwardly pivoting side panel. The type-2 style of the shade container is depicted in the perspective views of FIGS. 2A and 2B, in the top view of FIG. 2C, and in the lateral cross sectional views of FIGS. 6A and 6B.

Perspective views of a type-2 shade container 200 are shown in FIGS. 1A and 1B, in the closed and open positions, respectively. Similar to the type-1 container, the type-2 container is built upon a rigid, immobile structural framework, typically constructed from steel. As shown in FIG. 2B, the structural framework includes minimally four vertical sections 282 as well as top and bottom horizontal sections. The horizontal sections of the rigid framework can be simple cross bars, where the top panel 210 and bottom panel 220 are fixed to that framework. Alternatively, the rigid frame can incorporate (i.e., integrate) the top panel 210 and bottom panel 220 as part of the rigid framework. The rigid frame 282 of the container serves as the anchor point for the side panels and other structures that are attached to the framework.

The type-2 shade container 200 comprises four side panels 240, 241, 243 and 250, a fixed top ceiling panel 210 and a fixed bottom floor panel 220. See FIGS. 2A and 2B. In the closed position, each of the four side panels 240, 241, 243 and 250 are folded into the structure and are in a vertical orientation. When in the closed position, these four side panels, in combination with the top panel 210 and bottom panel 220, form a cube geometry (FIG. 2A). In this example, the container in the closed position is approximately 8 feet in each dimension length, width and height.

There are three types of side panels that form the type-2 shade container. One of the side panels 240 of the type-2 container 200 is an upwardly pivoting side panel that contains two extendable shade elements 270 and 271, similar in design to that used in the type-1 container. See FIG. 2B. When in the closed position, the extendable shade elements 270 and 271 are recessed within the side panel 240. When this side panel is raised into a horizontal open position coplanar with the top panel 210, the extendable shade elements 270 and 271 are pulled outward from the side panel to increase the shaded area below the container.

The type-2 container 200 contains two upwardly pivoting side panels 241 and 243 that do not contain any extendable shade elements, similar in design to those used in the type-1 container. These two panels 241 and 243 are installed on opposite vertical faces of the container.

The top edges of each of the three upwardly pivoting side panels 240, 241 and 243 are attached to the top of the container structure by fastening to a horizontal element on the rigid frame, or fastening to the top panel 210, where the top panel is fixed to the rigid frame or has been integrated into the rigid frame. See FIGS. 2B, 6A and 6B. The fastening is by a rotating fastener such as a hinge. This fastening system permits the side panels to rotate upwards to a horizontal position that is coplanar with the top panel 210.

Unlike the type-1 container, the type-2 container integrates one downwardly pivoting side panel 250. See FIGS. 2B, 6A and 6B. This downwardly pivoting side panel 250 is moveably secured along its bottom edge to the bottom of the container, e.g., to the floor panel or to a horizontal structural element at the bottom of the container. The fastening uses a rotatable fastening mechanism, such as a hinge.

Figure 2C:
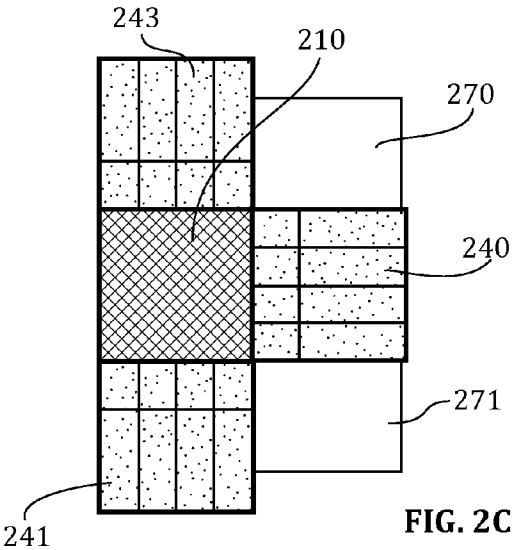
FIG. 2C provides a top view diagram of a type-2 modular shade container in the fully open deployed position.
Figure 2A:
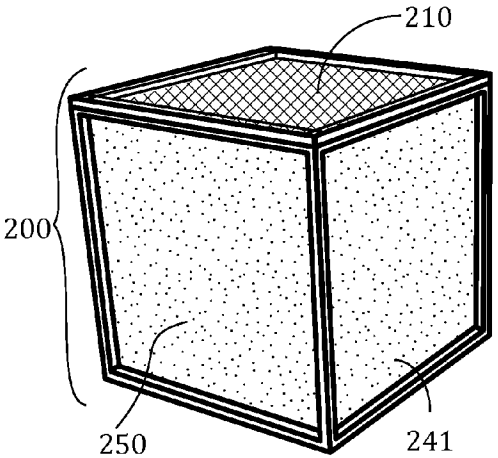
FIG. 2A provides a perspective view diagram of a type-2 shade container 200 in the fully closed position.

A top view of a fully opened type-2 container is provided in FIG. 2C. As illustrated in that figure, all three upwardly pivoting side panels 240, 241 and 243 are raised to a horizontal position that is approximately coplanar with the fixed top panel 210. After side panel 240 is raised into the horizontal position, the extendable shade elements 270 and 271 are pulled outward from the panel in order to expand the shaded area below the container. Side panels 241 and 243 are also raised, but do not contain any extendable shade elements. This process is reversed when the container is closed into a cube position. Because this container contains only three upwardly pivoting side panels 240, 241 and 243, the shade footprint of the type-2 container is smaller than the shade footprint of the type-1 container.

The structure and function of the side panels in a type-2 container can also be understood when viewed in lateral cross section. FIGS. 6A (closed position) and 6B (open position) show cross sections of a type-2 container where the transect crosses side panels 240 and 250. As shown in these figures, side panel 240 contains two extendable shade elements 270 and 271. In the closed position, side panels 240 and 250 are disposed about the rigid frame 282 of the container (FIG. 6A).

In the open position, side panel 240 is rotated upwards to a horizontal position nearly coplanar with the top panel 210 (FIG. 6B). The upper edge of side panel 240 is the only edge of that panel that is fastened to the container, and where that attachment, e.g., by a hinge, permits rotation of the panel upwards. In the open position, side panel 250 is rotated downwards to a horizontal position nearly coplanar with the bottom panel 220 (FIG. 6B). The bottom edge of side panel 250 is the only edge of that panel that is fastened to the container, and where that attachment, e.g., by a hinge, permits rotation of the panel downwards.

The downwardly pivoting side panel 250 can optionally be operated by use of a pulley system 255 that is installed inside the container, where the pulley system 255 allows the operator to safely and with a minimum of effort to lower and raise the downwardly pivoting side panel 250. See FIGS. 6A and 6B.

A lateral cross section of a type-2 container where the transect crosses side panels 241 and 243 would hypothetically look identical to the lateral cross section of a type-1 shade container where the transect of the container passes through side panels 141 and 143 in that type-1 container (see FIGS. 5A and 5B). The panels 241 and 243 in the type-2 container are identical to panels 141 and 143 in the type-1 container, in that that do not contain any extendable shade elements.

In the closed position, side panels 241 and 243 are disposed, but not fixed, about the rigid frame 282 of the container. In the open position, side panels 241 and 243 are rotated to a horizontal position nearly coplanar with the top panel 210 (FIG. 2B). The upper edges of side panels 141 and 143 are the only edges of those panels that are fastened to the container, and attachment is a rotatable attachment, e.g., by a hinge which permits rotation of the panels upwards.

When the type-2 shade container is in the open position, it can optionally utilize vertical support columns or poles 190, as shown throughout the drawings, for example, FIGS. 2B and 6B, identical to the support poles used in the type-1 shade container. These vertical support poles 190 are positioned at or near the distal ends of the deployed upwardly pivoting side panels 240, 241 and/or 243, and extend to the ground in order to provide added support to uphold the weight of the side panels and maintain the side panels in a horizontal position. These support poles can be detachable from the container structure, and can be made in multiple short sections to facilitate transportation and storage. Alternatively, the poles can be physically integrated into the container design such that they collapse or fold out of the way when the side panels are folded into the closed position and where the poles remain attached to the container in the closed position. The support poles can further integrate a stabilizing pole support base 195, where the bottom end of the pole contacts the pole support base 195 instead of directly contacting the ground (see FIG. 6B).

The type-2 shade container can optionally include one or more hydraulic arm system 180 to support the weight of an upwardly pivoting side panel 240, 241, 243, lock the side panel into the open position, and to facilitate the opening and closing of the side panels. See, for example, FIGS. 2B and 6B. See also the detail of a hydraulic arm system in FIG. 12. One or more hydraulic arm system 180 can also be installed for use with the downwardly pivoting side panel 250 to assist the operator in lowering and raising the side panel. A single side panel can use one hydraulic arm, or alternatively, can use two hydraulic arms, where one arm is positioned on each edge of the side panel.

The type-2 shade container can optionally utilize one or more ramp, which can be either integrated and rotatably fastened to the container structure, or alternatively, can be entirely detachable and independent from the container structure.

Example 3

Tandem Modular Shade Systems

Another application of the type-1 and type-2 shade containers is the simultaneous use of two or more shade containers to construct larger sheltered areas. In one embodiment as described in this example, the sheltered area includes not only the areas directly beneath the containers, but also includes larger sheltered areas that lie between the two containers. This is accomplished by the use of supplemental shade elements that can span the distance between two containers, and where the containers serve as the anchors for the supplemental shading materials. This example describes one configuration of a tandem modular shade system that uses two shade containers. The system uses one type-1 shade container and one type-2 shade container.

The tandem shade systems of the invention use at least one rolling shade element 320. That rolling shade element 320 is installed typically on the top of either a type-1 or type-2 shade container. The examples herein utilize type-2 containers to install the rolling shade element 320.

FIGS. 6A and 6B depict a modified type-2 shade container that contains a rolling shade element 320. FIG. 11 provides a detailed view of a rolling shade element 320. FIGS. 10A-10D depict other aspects of the rolling shade element system. As seen in these figures, the rolling shade element 320 minimally comprises a fabric shade material 332, typically but not exclusively in the form of a fabric roll 330. The fabric material 332 is in the rolled position 330 prior to its deployment, and is unrolled, either completely or partially, when it is deployed. The fabric utilized to make the shade material is not limited in any regard. The fabric used in the present example is a rolled canvas fabric, although other types of fabrics and other flexible materials, natural or synthetic, can be used. The rolling shade element 320 can optionally include a housing 340 within which the fabric material is rolled 330 and stored between uses. The rolling shade element 320 is optionally controlled or assisted by a motor 350 that is operated to either unwind or wind the fabric shade material 332 (see FIGS. 10A-10D).

The rolling shade element 320 can be attached to the top panel 210 or to the structural framework of the container, for example by using attachment bolts 360, and is typically (but not exclusively) installed directly above the downwardly pivoting side panel 250 of a type-2 container 200. See FIGS. 6A and 6B, and FIGS. 8A-8B. Alternatively, the rolling shade element 320 can be attached to a horizontal support element at the top of the container.

One embodiment of a tandem modular shade system is depicted in FIGS. 8A-8D. As shown, more than one rolling shade element 320 can be installed on a shade container. The system depicted in FIGS. 8A-8D has installed three rolling shade elements 320 (depicted as the rolling shade element housings 340) on one type-2 container. In that system, the housing 340 are located on the top ceiling panel 210 directly above the downwardly pivoting side panel 250, as well as one the leading edges of the upwardly pivoting side panels 241 and 243. When that type-2 container is fully opened, the three rolling shade element housings 340 are all horizontal and aligned linearly edge-to-edge along the top edge of the opened deployed container.

Figures 8A, 8B, 8C, 8D:
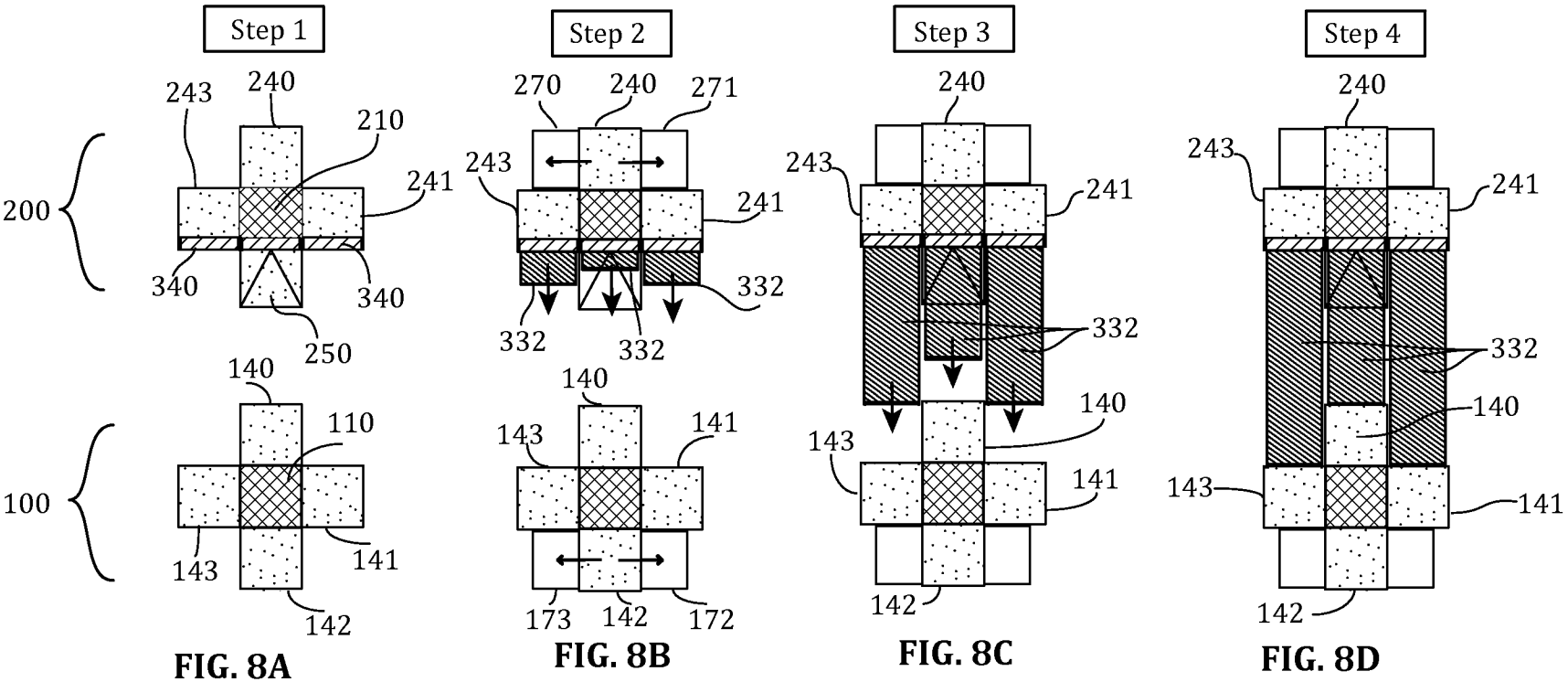
FIGS. 8A through 8D provide illustrations demonstrating the simultaneous use of two shade containers in a modular system to construct a large sheltered area, where rolling shade elements are used in conjunction with the shade containers. The system depicted in FIGS. 8A through 8D uses one type-1 shade container and one type-2 shade container.
Figures 10A, 10B, 10C, 10D:
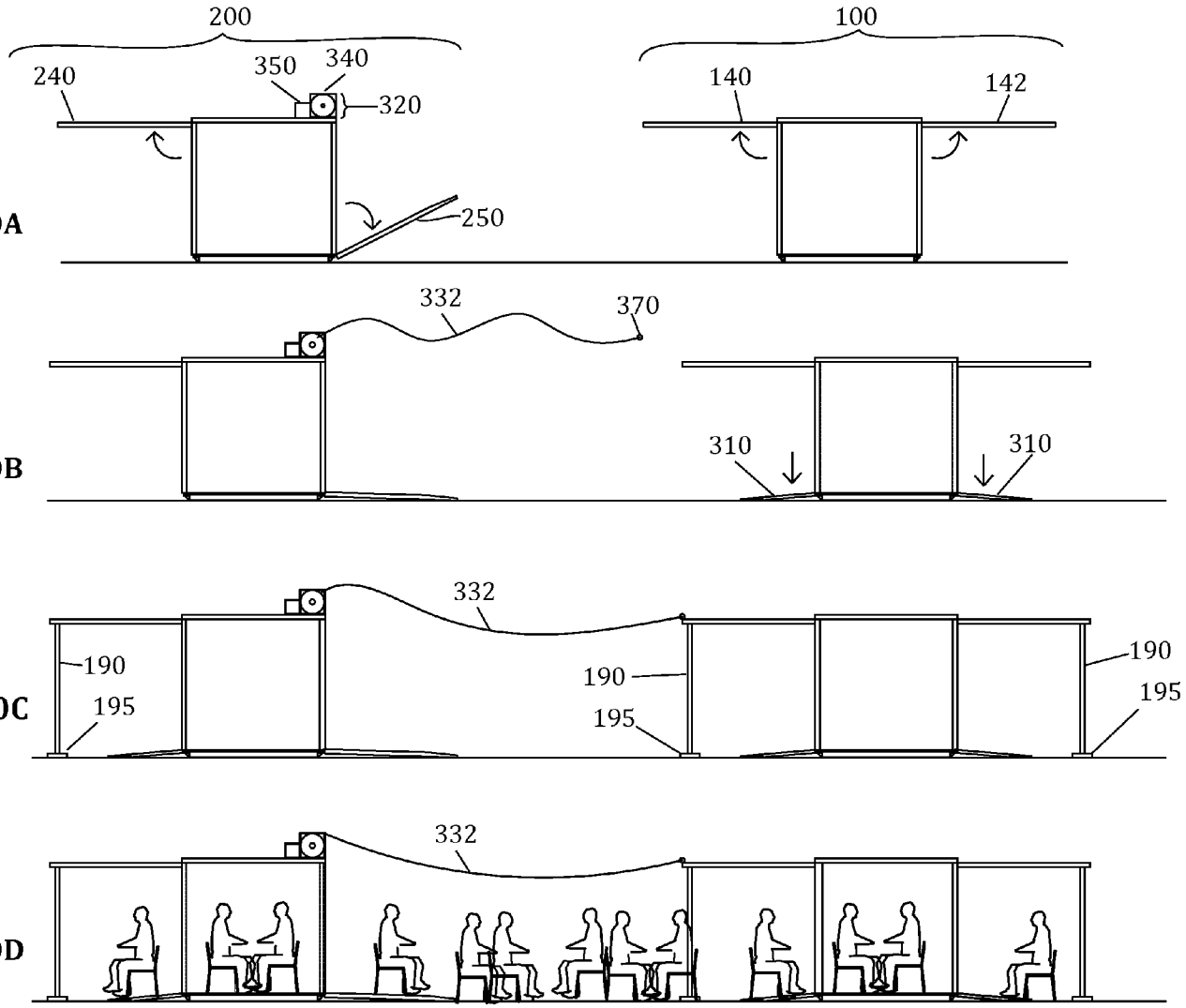
FIGS. 10A through 10D provide side-view illustrations depicting the assembly of an extended shade area using one type-1 shade container, one type-2 shade container and at least one rolling shade element. The configuration depicted in FIGS. 10A through 10D corresponds to the configuration shown in FIGS. 8A through 8D.
Figure 11:
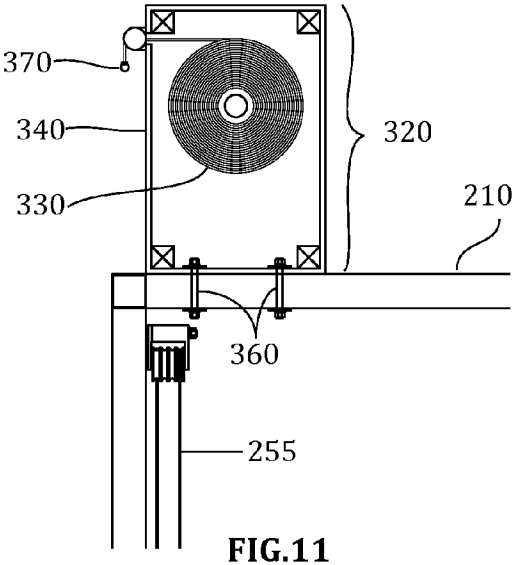
FIG. 11 provides a cross sectional view of a rolling shade element 320 that is mounted to the top of a type-2 shade container. The rolling shade housing 340, the rolled fabric shade material 330 and the shade fastener coupling mechanism 370 are shown.

The deployment of the rolling shade element 320 to create a tandem modular shade system is shown in a top view in FIGS. 8A-8D, and is also shown in a side view in FIGS. 10A-10D. Referring to FIGS. 8A and 10A, one type-2 container 200 and one type-1 container 100 are aligned and positioned near each other, with a gap between the two structures. FIG. 8A. The containers are deployed into their fully open positions (FIGS. 8B-8D, 10B and 10C), where the extendable shade elements 172, 173, 270 and 271 are extended from their respective side panels 142 and 240 in the direction indicated by the horizontal arrows. The gap between the containers can be, for example, about 10 feet, 20 feet, 30 feet, 40 feet or 50 feet, or at least 10 feet, at least 20 feet, at least 30 feet, at least 40 feet, or more, as measured by the distance between the face of the type-2 container cube and the closest point of the upward pivoting side panel 140 on the type-1 container 100.

Fabric shade material 332 is extended from the rolling shade element housings 340 on the type-2 container, towards the type-1 container (see FIGS. 8B and 8C and 10B) in the direction indicated by the vertical arrows. The shade material 332 is extended until it reaches the edges of the type-1 container, and the shade material is then attached to the type-1 container (FIG. 8D and FIG. 10C).

The site of attachment means for attaching of the fabric shade material 332 to the recipient container is not particularly limited. In this present Example, the type-1 container is the recipient container. For example, the attachment can be made by using attachment structures that are located on the top edge of the structural framework (e.g., the rigid frame) of the container, on the top panel 110 of the container, on the edges of the opened horizontal side panels (e.g., 140, 141 or 143), or on the edges of the extendable shade elements (e.g., 170 and/or 171). The recipient type-1 container contains three sets of attachment structures in order to secure the fabric shade material being extended from the three rolling shade elements and housings 340 on the container 200. As shown in FIG. 8D, the rolling shade material 332 is attached to the distal edges of the panels 140, 141 and 143 on the recipient container 100. However, the rolling shade material 332 can be attached to any position on the recipient containers, and is not limited to the distal edges of the recipient panels 140, 141 and 143.

The fabric shade material 332 is fastened to the recipient container by any suitable fastening system that uses any suitable attachment means. The means for attachment is not particularly limited. In some embodiments, a fastening system will comprise fastening structures attached to the fabric shade material (i.e., shade material fastening structures) and complementary fastening structures installed on the recipient container (i.e., container fastening structures) that can mate with the fastening structures on the shade material. An effective fastening system comprises shade material fastening structures and compatible container fastening structures which can be mated to each other, resulting in the shade material effectively fastened to the recipient container. The type-1 container is thus modified to contain any suitable structure that is able to capture and secure the fabric material that has been extended from the type-2 container by means of any suitable fastening structures. The fastening structures can be of any design, for example, any combination of hooks, loops, eyelets, lockrings, or similar or functionally equivalent structures that are installed on the fabric edge and the recipient container.

Figure 13:
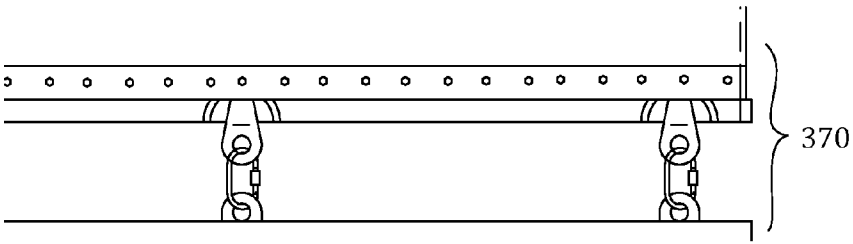
FIG. 13 provides an illustration of a fastening mechanism of a rolling shade element, where the fastening mechanism attaches the fabric shade material to an adjacent shade container.

One example of a fabric shade fastening system 370 finding use with the invention is shown in FIG. 13. The fabric shade material 332 extended from the rolling shade element 320 and housing 340 installed in the type-2 container 200 is then secured to the type-1 container 100 by the fastening system 370 (see FIGS. 8D, 10C and 10D), thereby creating an extended shade area between the type-1 and type-2 containers.

When multiple rolling shade element housings 340 are installed on the same shade container, such as shown in FIGS. 8A-8D, the deployed fabric material 332 extending from the three different rolling shade element housings 340 can be advantageously positioned and aligned to either be overlapping or non-overlapping when extended to the adjacent recipient shade container.

In some embodiments, optional ramps 310 can be used adjacent to the floor panels of either one or both of the type-1 or type-2 containers that make up the tandem modular shade system in order to facilitate stepping into or out of the containers (e.g., see FIGS. 10B and 10C).

Example 4

Extended Modular Shade Systems Using Rolling Shade Elements

Another advantageous application of the type-1 and type-2 shade containers is in the design of extended modular shade systems that use three or more shade containers to construct a single, large shaded area. The design and application of these extended systems is similar to the tandem shade systems described in Example 3, except that the extended shade system incorporates three or more shade containers. FIGS. 9A and 9B provide illustrations demonstrating two embodiments of extended modular shade systems of the invention.

The extended modular shade systems of the present example utilize two type-2 shade containers and one type-1 shade container. FIG. 9A provides an illustration of an "L" shaped extended modular shade system. In this configuration, the two type-2 containers 200 are positioned at the termini of the "L" and the single type-1 container 100 lies at the mid-point 90-degree angle of the "L." The two type-2 containers 200 are identical to those described in Example 3, where each type-2 container has three rolling shade elements 320 contained in housings 340, where the housings are arranged horizontally and linearly when the container is in the open, deployed position.

The recipient type-1 container 100 contains six sets of attachment structures in order to secure the six fabric shades being extended from the two type-2 containers 200. Each of the type-2 containers anchors three rolling shade elements. Thus, the single type-1 container 100 must contain six sets of attachment structures. In this configuration (FIG. 9A), three sets of attachment structures are on one face of the type-1 container, and the second set of three attachment structures are on the adjacent face (i.e., the face of the container that is pointed 90-degrees from the first face) of the type-1 container.

FIG. 9B provides an illustration of an extended modular shade system in a linear orientation. In this configuration, the three shade containers are aligned in a row, where two type-2 containers 200 are positioned at the termini of the row and the single type-1 container 100 lies between the two type-2 containers. In the embodiment shown in FIG. 9B, the type-1 container is positioned at about the midpoint between the two type-2 containers, and is equidistant from the type-2 containers. In other embodiments, the type-I container need not be equidistant from the type-2 container termini.

The two type-2 containers 200 shown in FIG. 9B are identical to those depicted in FIG. 9A. The recipient type-1 container 100 shown in FIG. 9A is similar to the type-1 container shown FIG. 9A, except that six sets of attachment structures have a different configuration. In the type-1 container shown in FIG. 9B, three sets of attachment structures are on one face of the type-1 container, but the second set of three attachment structures are installed on the opposite (i.e., opposing) face of the container pointed 180 degrees from the first face.

This example describes two embodiments of extended modular shade systems of the invention, which are an "L-shaped" extended modular shade system and a "linear"

extended modular shade system, where each system uses a total of three shade containers to form the extended shade areas. However, it is not intended that the invention be limited to these configurations, as other configurations are contemplated, including larger configurations that incorporate more than three shade containers. Other configurations in addition to the two specifically recited herein are within the scope of the invention.

Example 5

Directly Coupled Modular Shade Systems

This Example describes an alternative embodiment in the design of modular shade systems that utilizes at least two adjacent shade containers that are directly coupled to each other to form a larger shade structure. One example of a direct coupling modular shade system is shown in FIGS. 14A-14F. In contrast to the shade system described in Example 4, the directly-coupled modular shade system described in this present example uses only the shade containers themselves to create the sheltered area. This direct coupling modular shade system does not utilize any type of supplemental materials (such as fabric roller shades) that span the distance between the two or more containers.

FIGS. 14A through 14F provide illustrations demonstrating the step-wise assembly of a modular shade system that is formed by the direct physical coupling of two shade modules directly to each other. FIGS. 14A through 14C provide sequential perspective view illustrations demonstrating assembly of the modular system. The embodiment shown in these figures incorporate one type-1 shade container (having at least one upwardly rotating side panel) and one type-2 shade container (having at least one downwardly rotating side panel), without the use of any extended rolling shade element. The deployment of the upwardly rotating side panel from one container and the downwardly rotating side panel from the opposing container forms an upper overhead shade panel and a lower floor panel in the same sheltered section.

FIG. 14A shows the two shade containers, namely container A 400 (a type-1 container) and container B 410 (a type-2 container), both in the fully closed positions. The containers are positioned at a defined distance apart from each other, which is approximately equivalent to the height of one side panel, for example, approximately eight feet apart. Container A 400 comprises at least one upwardly pivoting side panel 402, where that container is positioned such that the upwardly pivoting side panel 402 faces container B 410. Container B 410 comprises at least one downwardly pivoting side panel 412, where that container is positioned such that the downwardly pivoting side panel 412 faces and is in a parallel plane to the upwardly pivoting side panel 402 on container A 400.

After the two containers are positioned relative to each other, the downwardly pivoting side panel 412 from container B 410 and the upwardly pivoting side panel 402 from container A 400 are each deployed from their vertical closed positions into their open horizontal positions (not necessarily in that order). FIG. 14B shows the downwardly pivoting side panel 412 from container B 410 being lowered into the horizontal position in the direction shown by the arrow. The distal edge of the lowered panel 412 from container B 410 abuts container A 400, and may or may not physically contact container A 400.

FIG. 14C shows the upwardly pivoting side panel 402 from container A 400 being raised into the horizontal position in the direction shown by the arrow. The distal edge of the raised panel 402 from container A 400 abuts container B 410, and may or may not physically contact container B 410. After the side panels 402 and 412 are raised and lowered, respectively, into position, a protected shaded area between the two containers is created, where the protected area comprises both a top panel formed from panel 402 and a bottom floor panel formed from panel 412.

After the panels 402 and 412 are raised and lowered, respectively, into their horizontal positions abutting the adjacent container, they can optionally be physically secured into place or stabilized by physical attachment or connection to the adjacent container. For example, the downwardly pivoting side panel 412 from container B 410 can be secured to a lower horizontal portion of the rigid frame on container A 400, or can be attached to the bottom panel of container A 400. Similarly, the upwardly pivoting side panel 402 from container A 400 can be secured to an upper horizontal portion of the rigid frame on container B 410, or can be attached to the top panel of container B 410.

For example, the deployed panels 402 and 412 can be fastened to the adjacent container by any suitable means for temporarily securing the distal edges of side panels 402 or 412 to the adjacent container, for example, such as by physically resting the side panels on a surface of the opposing container, or can be secured by using any suitable type of attachment, for example, by hook, eyelets, latch, bracket, fastener, nut and bold assembly, pegs, clamps, or holes with corresponding pins.

Figure 14D:
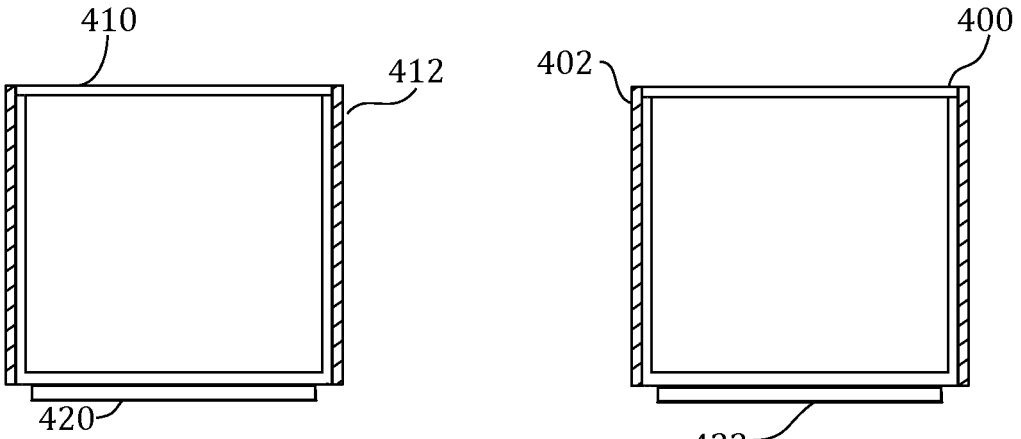
Figure 14E:
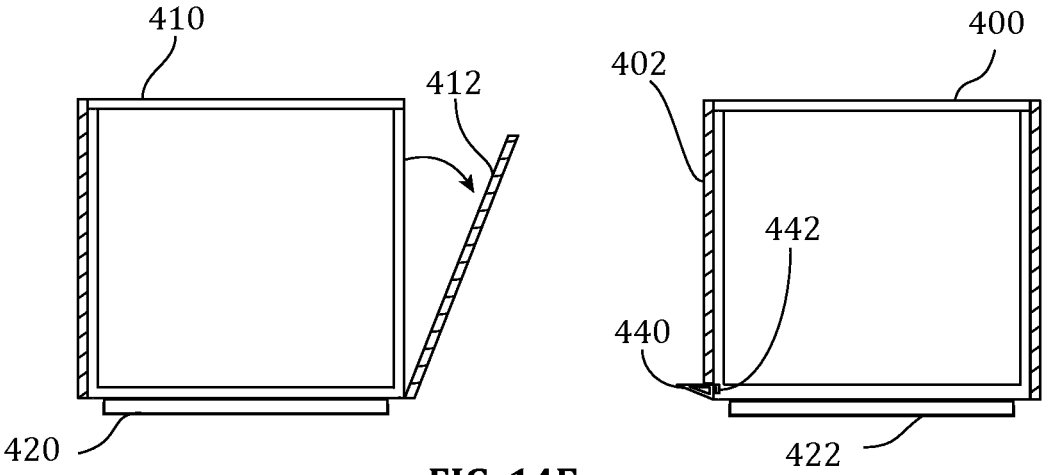
Figure 14F:
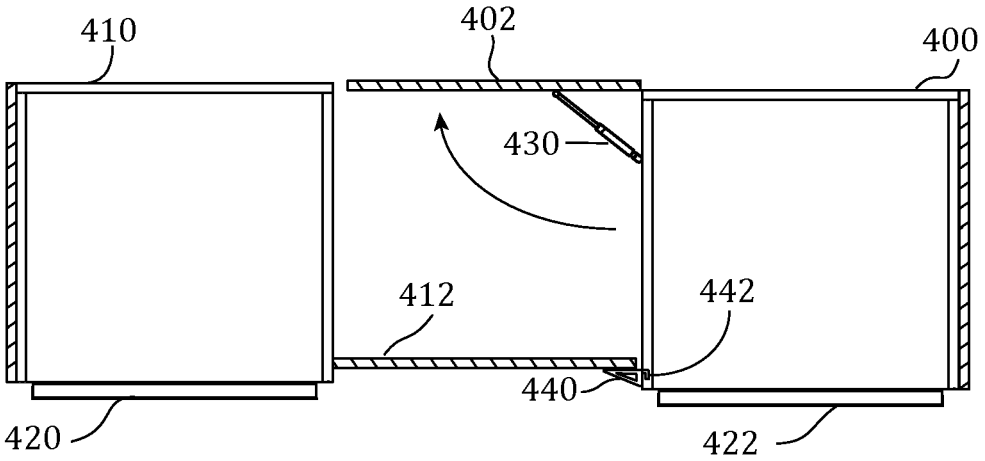

FIGS. 14D through 14F provide sequential side elevation views of the assembly of a directly-coupled modular shade system corresponding to the views provided in FIGS. 14A through 14C. FIG. 14D shows the two shade containers A 400 and B 410 in the fully closed positions. Forklift platforms 420 and 422 are also shown in these side elevation views. FIG. 14E shows container A 400 in the fully closed position and container B 410 in the process of deployment of one downwardly pivoting side panel 412 being lowered in the direction of the arrow into a horizontal position. Also shown is the attachment of a small detachable support platform 440 to a lower portion of the rigid frame of container A 400. The support platform 440 can be attached to container A 400 by a hook 442 on the platform that can insert into a slot in the rigid frame of container A 400. Two or more such platforms can be attached to the rigid frame of container A 400.

FIG. 14F shows container A 400 after deployment of the upwardly pivoting side panel 402. The weight of that raised side panel 402 can optionally be supported by a hydraulic arm system 430. FIG. 14F also shows the full deployment of the downwardly pivoting side panel 412 into a horizontal position from container B 410. As shown in the figure, panel 412 is resting on one more support platform 440.

Furthermore, but not shown in the drawings of FIGS. 14A-14F, shade container A 400 and/or shade container B 410 can each further comprise additional side panels that can be raised to further extend the shaded area. For example, shade container A 400 can have a structure similar or identical to a type-1 shade container (as shown in FIG. 1B), where all four side panels are upwardly pivoting and can be raised into an approximately coplanar horizontal position. Shade container B 410 can have a structure similar or identical to a type-2 shade container (as shown in FIG. 2B), where one of the side panels is downwardly pivoting, and the three remaining side panels can be raised into an approximately coplanar horizontal position.

Furthermore still, a side panel that is upwardly pivoting as used in the present example can optionally comprise extendable shade elements that can be deployed from within the side panel, for example, as depicted in FIGS. 1B and 1C. The upwardly pivoting side panel(s) of the present example can be similar or identical to the upwardly pivoting side panel 140 with extendable/retractable shade elements 170 and 171, as depicted in FIGS. 1B and 1C. The analogous structures 240, 270 and 271 shown in the type-2 shade container of FIGS. 2B and 2C similarly find use with the embodiment described in the present example.

It is not intended that this aspect of the invention be limited to the design shown in FIGS. 14A through 14F. For example, it is not intended that the invention be limited to the use of one type-1 shade container and one type-2 shade container to construct the shade system. For example, two type-1 shade containers can be functionally coupled in a manner similar to that described in this example, where the distal edges of two opposing raised side panels from two adjacent containers can be joined along their distal edges to create a shaded area twice as large as the shaded area shown in FIGS. 14C and 14F (but without creating a floor panel). The coupling of two raised panels can be any suitable method such as simply abutting the edges of the raised panels, or by any suitable fastening means.

Also for example, it is not intended that the invention be limited to the use of a type-2 shade container having a downwardly pivoting side panel to form a lower floor panel that lies below the shaded area as shown in FIGS. 14C and 14F. For example, the lower floor panel can be formed from a detachable ramp or detachable panel that is lowered into position.

Furthermore still, arrays of three or more shade containers of any type can be coupled in the manner generally described in this example to form still larger modular shade systems, for example, analogous to the arrays of three or more shade containers shown in FIGS. 9A and 9B.

It is contemplated that any two or more shade containers can be functionally coupled to form a modular shade system. Two or more shade containers are functionally coupled when they are abutted (and at least touching in one aspect), physically joined in any manner, connected or tethered to each other in any manner, indirectly connected by supplemental materials such as by an overhead fabric shade system like a roller shade. When the two or more shade containers are functionally coupled by the use of supplemental materials such as a fabric shade material spanning from one container module to a second container module, one end of the supplemental shade material is fastened to the first container, and the opposite end of the shade material is attached to the second container module.

While the foregoing disclosure has been described in some detail for purposes of clarity and understanding, it will be clear to one skilled in the art from a reading of this disclosure that various changes in form and materials can be made without departing from the scope of the invention. It is to be understood that the invention is not limited to any of the specifically recited materials or components recited herein, where similar or functionally equivalent materials and components can be substituted and used in the practice of the invention, and remain within the scope of the claimed invention. It is understood that the description and terminology used in the present disclosure is for the purpose of describing particular embodiments of the invention only, and it is not intended that the invention be limited solely to the embodiments described herein.

As used in this specification and the appended claims, singular forms such as "a", "an" and "the" include plural referents unless the content clearly dictates otherwise. All industry and technical terms used herein have the same meaning as commonly understood by one of ordinary skill in the art or industry to which the invention pertains, unless defined otherwise.

All publications, patents, patent applications, and/or other documents cited in this application are incorporated by reference in their entirety for all purposes to the same extent as if each individual publication, patent, patent application, and/or other document were individually indicated to be incorporated by reference for all purposes.

What is claimed is:

1. A container comprising:

(a) a rigid frame;

(b) a top panel fixedly disposed about an upper portion of the rigid frame;

(c) a bottom panel fixedly disposed about a lower portion of the rigid frame;

(d) a first vertical panel, a second vertical panel, a third vertical panel and a fourth vertical panel, each panel having an upper edge, a lower edge and two opposing side edges, wherein the vertical panels are:

i) moveably disposed about a first vertical portion, a second vertical portion, a third vertical portion, and a fourth vertical portion of the rigid frame, respectively;

ii) rotatably fastened at their respective upper edges to a first upper horizontal portion, a second upper horizontal portion, a third upper horizontal portion, and a fourth upper horizontal portion of the rigid frame, respectively; and iii) rotatable from closed, vertical positions adjacent to the first, second, third and fourth vertical portions of the rigid frame, respectively, to open positions that are substantially horizontal and substantially coplanar with the plane of the fixed top panel;

further where at least one of said first, second, third and fourth vertical panels comprises at least one extendable shade element, where in an open position the extendable shade element is extended from one side edge of the vertical panel into a position that is substantially horizontal and substantially coplanar with the plane of the top panel.

2. The container of claim 1, wherein the extendable shade element is selected from:

(a) a recessed extendable shade element, where in a closed position, the extendable shade element is recessed within the vertical panel, and is positioned between the internal face and external face of the vertical panel, and (b) a non-recessed extendable shade element, where in a closed position, the extendable shade element is moveably disposed about and substantially overlapping the external face of the vertical panel.

3. The container of claim 2, wherein two vertical panels each comprise two recessed extendable shade elements.

4. The container of claim 2, wherein each of the first, second, third and fourth vertical panels comprises one non-recessed extendable shade element.

5. The container of claim 1, further comprising at least one ramp, wherein (i) the proximal edge of the ramp abuts the fixed bottom panel or a lower horizontal portion of the rigid frame, and (ii) the ramp is detachable from the container.

6. The container of claim 1, further comprising at least one ramp, wherein (i) the proximal edge of the ramp is rotatably fastened to a lower horizontal portion of the rigid frame or the bottom panel, and (ii) the ramp is rotatable from a closed position that is either vertically oriented or horizontally oriented in a parallel plane substantially overlapping the fixed bottom panel, to an open position that is substantially horizontal and non-overlapping with the fixed bottom panel.

7. The container of claim 1, further comprising at least one hydraulic arm having a first end and a second end, where the first end is fastened to either the first, second, third or fourth vertical panel, and the second end is fastened to the rigid frame.

8. The container of claim 1, further comprising at least one electrical conduit.

9. The container of claim 1, further comprising at least one lighting system component.

10. The container of claim 1, further comprising at least one vertically-oriented support element when the container is in the open position, said support element comprising an upper end attached at or near the distal edge of any one of the rotatably fastened panels, and a lower end contacting the ground or a structure that is contacting the ground.

11. A container comprising:

(a) a rigid frame forming four vertical faces;

(b) a top panel fixedly disposed about an upper portion of the rigid frame;

(c) a bottom panel fixedly disposed about a lower portion of the rigid frame;

(d) a first vertical panel, a second vertical panel, a third vertical panel and a fourth vertical panel, each panel having an upper edge, a lower edge and two opposing side edges, wherein each vertical panel is moveably disposed about a different vertical face of the rigid frame, wherein:

(i) at least one of the vertical panels is an upwardly-rotatable vertical panel that is rotatably fastened at its upper edge to an upper horizontal portion of the rigid frame on its respective vertical face of the rigid frame, that is rotatable from a closed, vertical position adjacent to its respective face of the rigid frame, to an open position that is substantially horizontal and substantially coplanar with the plane of the fixed top panel, and wherein the upwardly-rotatable vertical panel includes at least one extendable shade element, where, in an open position the extendable shade element is extended from one side edge of the upwardly-rotatable vertical panel into a position that is substantially horizontal and substantially coplanar with the plane of the top panel, and (ii) at least one of the vertical panels is a downwardly-rotatable vertical panel that is rotatably fastened at its lower edge to a lower horizontal portion of the rigid frame on its respective vertical face of the rigid frame, and is rotatable from a closed, vertical position adjacent to its respective face of the rigid frame, to an open position that is substantially horizontal and substantially coplanar with the plane of the fixed bottom panel.

12. The container of claim 11, comprising three upwardly rotatable vertical panels, and one downwardly-rotatable vertical panel.

13. The container of claim 11, wherein:

(a) the first and the second vertical panels are upwardly rotatable vertical panels, (b) the third vertical panel is an upwardly-rotatable vertical panel comprising two recessed extendable shade elements, where in a closed position, the extendable shade elements are recessed within the third vertical panel, and are both positioned between the internal face and external face of the vertical panel, and where in an open position the two extendable shade elements are extended from opposing side edges of the third vertical panel into positions that are substantially horizontal and substantially coplanar with the plane of the top panel, and (c) the fourth vertical panel is a downwardly-rotatable vertical panel.

14. The container of claim 11, further comprising at least one hydraulic arm having a first end that is attached to the upwardly-rotatable vertical panel, and a second end that is attached to the rigid frame.

15. The container of claim 11, further comprising at least one electrical conduit.

16. The container of claim 11, further comprising at least one lighting system component.

* * * * *